US008016408B2

(12) United States Patent
Sugai

(10) Patent No.: US 8,016,408 B2
(45) Date of Patent: Sep. 13, 2011

(54) PRINTING DEVICE

(75) Inventor: Keigo Sugai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 341 days.

(21) Appl. No.: 12/388,108

(22) Filed: Feb. 18, 2009

(65) Prior Publication Data

US 2009/0213200 A1 Aug. 27, 2009

(30) Foreign Application Priority Data

Feb. 27, 2008 (JP) ..... 2008-046067

(51) Int. Cl.
*B41J 2/01* (2006.01)

(52) U.S. Cl. ..... 347/102; 347/101

(58) Field of Classification Search ..... None
See application file for complete search history.

(56) References Cited

U.S. PATENT DOCUMENTS

| | | | | |
|---|---|---|---|---|
| 6,739,716 | B2 * | 5/2004 | Richards | 347/102 |
| 6,861,203 | B2 * | 3/2005 | Gelbart | 430/306 |
| 7,264,346 | B2 * | 9/2007 | Nishino et al. | 347/102 |
| 7,470,921 | B2 | 12/2008 | Custer | |
| 7,776,492 | B2 * | 8/2010 | Miura | 430/5 |
| 2004/0179079 | A1 | 9/2004 | Yokoyama | |
| 2007/0184141 | A1 | 8/2007 | Custer | |
| 2008/0074887 | A1 * | 3/2008 | Nakata et al. | 362/310 |

FOREIGN PATENT DOCUMENTS

| | | | | |
|---|---|---|---|---|
| JP | 61-136411 | U | | 8/1986 |
| JP | 03-060733 | A | | 3/1991 |
| JP | 3-060733 | A | | 3/1991 |
| JP | 03-086509 | U | | 9/1991 |
| JP | 04-041511 | U | | 4/1992 |
| JP | 2004-181941 | A | | 7/2004 |
| JP | 2005125792 | A | * | 5/2005 |
| JP | 2005-153193 | A | | 6/2005 |
| JP | 2006-286206 | A | | 10/2006 |
| JP | 2007-090343 | A | | 4/2007 |
| JP | 2007-096207 | A | | 4/2007 |
| JP | 2007290233 | A | * | 11/2007 |
| JP | 2009184231 | A | * | 8/2009 |

* cited by examiner

*Primary Examiner* — Stephen Meier
*Assistant Examiner* — Leonard Liang
(74) *Attorney, Agent, or Firm* — Global IP Counselors, LLP

(57) ABSTRACT

A printing device includes a liquid spraying head unit and a light radiation head unit. The liquid spraying head unit is configured and arranged to spray a photo-curable liquid to a printing medium. The light radiation head unit is configured and arranged to radiate curing light rays to the photo-curable liquid on the printing medium to cause the photo-curable liquid to be cured. The light radiation head unit includes a light emitting body and a reflector. The light emitting body is arranged on a light source arrangement surface extending non-parallel to the printing medium. The reflector is configured and arranged to reflect the curing light ray emitted from the light emitting body toward the photo-curable liquid sprayed on the printing medium. The reflector is arranged on a reflector arrangement surface facing the light source arrangement surface and extending non-parallel to the printing medium.

13 Claims, 12 Drawing Sheets

PRINTING DEVICE

CROSS-REFERENCE TO RELATED APPLICATIONS

This application claims priority to Japanese Patent Application No. 2008-046067 filed on Feb. 27, 2008. The entire disclosure of Japanese Patent Application No. 2008-046067 is hereby incorporated herein by reference.

BACKGROUND

1. Technical Field

The present invention relates to a printing device for spraying and printing an ultraviolet-curable liquid or other photo-curable liquid on a printing medium.

2. Related Art

In a conventional printing device configured to spray and print an ultraviolet-curable liquid or other photo-curable liquid on a printing medium, an ultraviolet radiating unit is provided for radiating ultraviolet rays to droplets of the ultraviolet-curable liquid that are sprayed from, for example, a liquid spraying head and landed on the surface of the printing medium to cause the droplets on the surface of the printing medium to cure. This ultraviolet radiating unit is provided in combination with the liquid spraying head, for example, and moves along with the liquid spraying head, and the sprayed droplets are thereby rapidly cured.

High-pressure mercury lamps, hot cathode tubes, and the like are used as ultraviolet light emitting bodies in the ultraviolet radiating unit. Japanese Laid-Open Patent Application No. 2005-153193 proposes using UVLED (Ultra Violet Light Emitting Diode) or UVLED array units (in which a plurality of UVLED is arranged).

SUMMARY

When an array unit in which a plurality of UVLED or other light emitting elements is arranged is used as an ultraviolet emitting body, there are certain limitations on the area in which the ultraviolet radiating unit can be provided, particularly when the ultraviolet radiating unit is moved together with the liquid spraying head. A number of light emitting elements sufficient to create the desired light intensity must therefore be provided within a limited area. The light emitting elements are aligned in a plane so as not to waste space.

However, there is a need for a printing device that is capable of emitting a greater light intensity and more adequately curing the ultraviolet-curable liquid.

The present invention was therefore developed in view of this yet-unresolved drawback of the prior art, and an object of the present invention is to provide a printing device that increases the light intensity of a light emitting head for emitting curing light rays to a photo-curable liquid that is sprayed on a printing medium, and more adequately curing droplets of the sprayed photo-curable liquid.

A printing device according to a first aspect includes a liquid spraying head unit and a light radiation head unit. The liquid spraying head unit is configured and arranged to spray a photo-curable liquid to a printing medium. The light radiation head unit is configured and arranged to radiate curing light rays to the photo-curable liquid sprayed on the printing medium to cause the photo-curable liquid to be cured. The light radiation head unit includes a light emitting body and a reflector. The light emitting body is configured and arranged to emit the curing light ray. The light emitting body is arranged on a light source arrangement surface extending non-parallel to the printing medium. The reflector is configured and arranged to reflect the curing light ray emitted from the light emitting body toward the photo-curable liquid sprayed on the printing medium. The reflector is arranged on a reflector arrangement surface facing the light source arrangement surface and extending non-parallel to the printing medium.

In the light radiation head in this configuration, the surface area occupied by the light emitting bodies in the surface parallel to the printing medium is smaller when the emission direction with respect to the printing medium is tilted than in a case in which the light emitting bodies are arranged so that the direction of the emitted light of the light emitting bodies is perpendicular to the printing medium.

Consequently, a larger number of light emitting elements can be arranged in a limited area having a surface parallel to the irradiated subject as the bottom, by arranging the light emitting bodies in a surface that is not parallel to the printing medium on which the photo-curable liquid is sprayed, and causing the emitted light of the light emitting bodies to be reflected by the reflector toward the photo-curable liquid that has been sprayed onto the printing medium. The light intensity can therefore be increased without entailing an increase in the size of the light radiation head as such, and the droplets composed of the photo-curable liquid sprayed on the printing medium can be adequately cured.

In the printing device described above, the light radiation head unit preferably further includes an auxiliary reflector disposed adjacent to the reflector, and configured and arranged to reflect at least one of the curing light ray emitted from the light emitting body and light reflected by the reflector toward the photo-curable liquid sprayed on the printing medium.

The emitted light of the light emitting bodies can be efficiently radiated to the photo-curable liquid that has been sprayed onto the printing medium, by causing the emitted light of the light emitting bodies to be reflected by the reflector toward the photo-curable liquid that has been sprayed onto the printing medium, and causing the emitted light of the light emitting bodies or the reflected light of the reflector to be further reflected by the auxiliary reflector to the photo-curable liquid that has been sprayed onto the printing medium.

In the printing device described above, the light radiation head unit preferably includes a rectangular parallelepiped member having an emission port that faces the printing medium. The light source arrangement surface is preferably disposed adjacent to an inside of a first side surface of the rectangular parallelepiped member. The reflector arrangement surface is preferably disposed adjacent to an inside of a second side surface of the rectangular parallelepiped member facing the first side surface. The auxiliary reflector is preferably arranged on third and fourth side surfaces of the rectangular parallelepiped member extending between the first and second side surfaces.

Providing a radiation mechanism including the light emitting body and the reflector inside the rectangular parallelepiped member makes it possible to reduce the likelihood of the light emitting bodies colliding with an obstruction while the light radiation head is moving during printing or other functioning.

In the printing device described above, the light radiation head unit preferably further includes a plurality of additional rectangular parallelepiped members so that the rectangular parallelepiped member and the additional rectangular parallelepiped members are connected together.

Forming a single light source by connecting a plurality of members makes it possible to easily create a light radiation head that has a radiation area suited to the size or other characteristics of the printing medium by adjusting the number of connected members.

In the printing device described above, the light radiation head unit preferably includes first and second rectangular parallelepiped members with each of the first and second rectangular parallelepiped members having an emission port facing the printing medium and an opening section provided on a first side surface of each of the first and second rectangular parallelepiped members. Each of the first and second rectangular parallelepiped members preferably includes the light source arrangement surface extending between the first side surface and a second side surface of the rectangular parallelepiped member facing the first side surface, with the light source arrangement surface being tilted so that an upper portion of the light source arrangement surface is disposed adjacent to the first side surface. Each of the first and second rectangular parallelepiped members preferably includes the auxiliary reflector arranged on third and fourth side surfaces extending between the first and second side surfaces. The first and second rectangular parallelepiped members are preferably connected together so that the first side surface of the second rectangular parallelepiped member is disposed adjacent to the second side surface of the first rectangular parallelepiped member. The reflector is preferably disposed on the second side surface of the first rectangular parallelepiped member so that the curing light ray emitted from the light emitting body on the light source arrangement surface of the second rectangular parallelepiped member is reflected by the reflector.

Providing the radiation mechanism inside the rectangular parallelepiped member makes it possible to reduce the likelihood of the light emitting bodies colliding with an obstruction while the light radiation head is moving during printing or other functioning. Since the emission port is also formed in a position facing the tilted surface in which the light emitting bodies are provided, adjustment and the like of the light emitting bodies provided inside the rectangular parallelepiped member can be facilitated.

In the printing device described above, the light radiation head unit preferably includes a cooling mechanism configured and arranged to cool the light emitting body with at least one of the light emitting body and the reflector being disposed adjacent to the cooling mechanism.

Since at least one of the light emitting body and the reflector is provided to the cooling mechanism, there is no need to provide a separate member for arranging the light emitting body and the reflector, and the size of the light radiation head can thus be reduced. The light emitting body can be efficiently cooled particularly by provided the light emitting body, which is a heat source, to the cooling mechanism.

In the printing device described above, the light emitting body is preferably embedded in the cooling mechanism.

The light emitting body is embedded in the cooling mechanism, and the light emitting body can thereby be efficiently cooled.

In the printing device described above, a plurality of additional light emitting bodies is preferably disposed on the light source arrangement surface.

A light radiation head that emits the desired light intensity can easily be obtained by adjusting the provided number of light emitting bodies.

A printing device according to a second aspect includes a liquid spraying head unit and a light radiation head unit. The liquid spraying head unit is configured and arranged to spray a photo-curable liquid to a printing medium. The light radiation head unit is configured and arranged to radiate curing light rays from a light emitting surface of the light radiation head unit to the photo-curable liquid sprayed on the printing medium to cause the photo-curable liquid to be cured. The light radiation head unit includes a base member and a light guiding section. The base member has a plurality of layers with each of the layers including a plurality of light emitting bodies configured and arranged to emit the curing light rays. The light guiding section is disposed in the base member, and configured and arranged to guide the curing light rays emitted from the light emitting bodies disposed in at least one of the layers to the light emitting surface.

In the light radiation head, arranging the light emitting bodies in multiple layers makes it possible to provide a larger number of light emitting bodies in a limited area, and specifically to obtain a larger number of arranged light emitting bodies per unit area than in a case in which the light emitting bodies are arranged in a plane. Since the emitted light of the light emitting bodies is guided to the surface of the light emitting part by the light guiding section, the emitted light of the light emitting bodies of an upper layer as viewed from the side of the light emitting unit can also be included in the light that is emitted from the light emitting unit. Consequently, since the emitted light of a larger number of light emitting bodies can be emitted from the light emitting part, the light intensity coming from a limited area can be further increased. The droplets composed of the photo-curable liquid that has been sprayed onto the printing medium can therefore be adequately cured.

In the printing device described above, the light emitting surface is preferably configured and arranged to extend substantially parallel to the printing medium. The light emitting bodies are preferably arranged in each of the layers generally parallel to a planar direction of the light emitting surface so that the light emitting bodies disposed on one of the layers are offset from the light emitting bodies disposed on the other of the layers when viewed in a direction perpendicular to the planar direction of the light emitting surface. The light guiding section preferably includes a light guide path extending from an emission surface of at least one of the light emitting bodies to the light emitting surface.

Since the light emitting bodies are in a dispersed arrangement so as not to overlap with each other as viewed in a plane, it is possible to prevent the light intensity from being irregularly concentrated in the area of irradiation by the light emitting part.

In the printing device described above, the light guiding section preferably includes an optical fiber.

It is thereby possible to reduce loss of emitted light when the emitted light of the light emitting bodies is guided by the light guiding section to the light emitting part surface.

In the printing device described above, each of the light emitting bodies preferably includes a surface-mounted light emitting body having a substantially flat emission surface. The base member is preferably formed by layering a plurality of substrates in which the light emitting bodies are embedded.

Since surface-mounted light emitting bodies are used as the light emitting bodies and embedded in a substrate, a base in which light emitting bodies are provided in multiple layers can easily be obtained merely by layering the substrates.

The printing device described above preferably further includes an air-cooling mechanism. The base member preferably includes a ventilation path communicated with the air-cooling mechanism to cool the light emitting bodies of each of the layers.

Heat given off by the light emitting bodies readily accumulates when a multi-layer structure is used, but heat can easily be dissipated by providing a ventilation path to the base.

The printing device described above preferably further includes an air-cooling mechanism. The light guiding section of the base member preferably forms at least a part of a ventilation path communicated with the air-cooling mechanism to cool the light emitting bodies of at least one of the layers.

Heat given off by the light emitting bodies readily accumulates when a multi-layer structure is used, but heat can easily be dissipated by providing a ventilation path to the base. The light guide path can also be effectively utilized as a ventilation path, and a commensurate reduction in the size of the ultraviolet radiation head can be anticipated.

In the printing device described above, the ventilation path preferably extends in the base member from a non-emitting side of each of the light emitting bodies to the light emitting surface via a portion adjacent to a side surface of the light emitting body.

The non-emitting side and side surfaces of the light emitting bodies are thereby cooled, and the light emitting bodies can therefore be effectively cooled.

BRIEF DESCRIPTION OF THE DRAWINGS

Referring now to the attached drawings which form a part of this original disclosure.

DETAILED DESCRIPTION OF EXEMPLARY EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
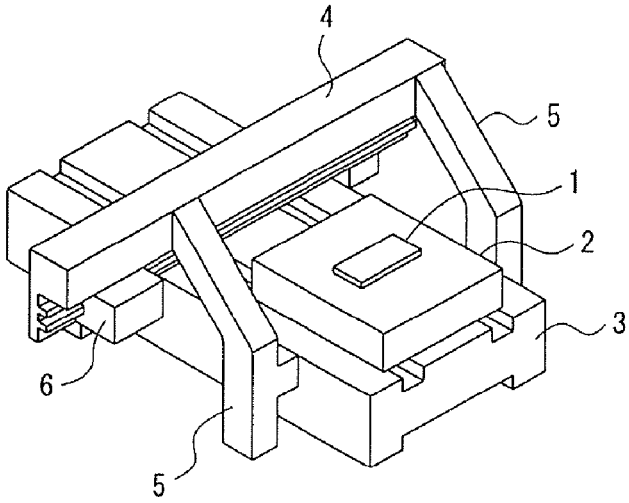
FIG. 1 is an overall schematic perspective view of a printing device in accordance with a first embodiment of the present invention.

Referring now to FIG. 1, a printing device in accordance with a first embodiment will be described. FIG. 1 is an overall schematic view of the printing device. In this example, a printing medium 1 used in the printing device is preferably an industrial product.

The printing medium 1 is fixedly mounted on a conveyance table 2, which is configured and arranged to move along a conveyance rail 3 from the right front direction of FIG. 1 to the left inward direction of FIG. 1. When the printing medium 1 has been discharged or removed from the conveyance table 2, the conveyance table 2 is conveyed along the conveyance rail 3 from the left inward direction of FIG. 1 to the right front direction of FIG. 1.

A carriage conveyance shaft 4 forms a lateral bridge across the conveyance rail 3 disposed generally above a midpoint in the longitudinal direction of the conveyance rail 3. A pair of support legs 5 for supporting the carriage conveyance shaft 4 is fixed to transverse end portions of the conveyance rail 3 as shown in FIG. 1.

A carriage 6 is attached to the carriage conveyance shaft 4 so as to be able to slide in the transverse direction of the conveyance rail 3, which is the axial direction, i.e., longitudinal direction, of the carriage conveyance shaft 4. A liquid spraying head unit 7 and a pair of ultraviolet radiation head units 8*a*, 8*b* (light radiation head units) described hereinafter are mounted to the carriage 6. Therefore, the liquid spraying head unit 7 and ultraviolet radiation head units 8*a*, 8*b* are configured and arranged to move in the direction orthogonal to the conveyance direction of the printing medium 1.

Figure 2:
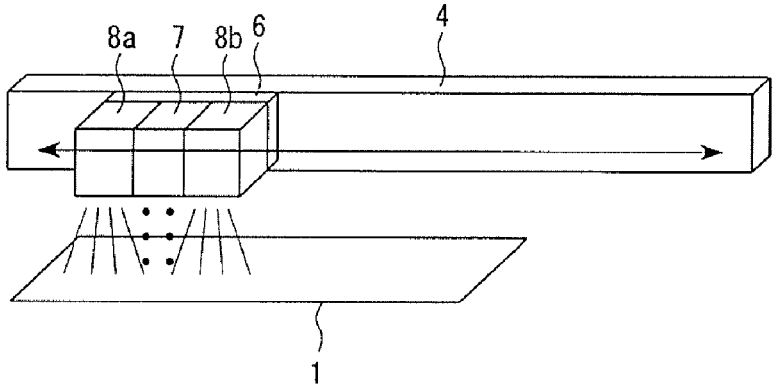
FIG. 2 is a schematic view of a carriage conveyance shaft and the vicinity of a carriage of the printing device shown in FIG. 1.

FIG. 2 shows a schematic view of the liquid spraying head unit 7 and the ultraviolet radiation head units 8*a*, 8*b* that are mounted to the carriage 6.

As shown in FIG. 2, the liquid spraying head unit 7 and the ultraviolet radiation head units 8*a*, 8*b* have a substantially rectangular block shape (rectangular parallelepiped). The ultraviolet radiation head units 8*a*, 8*b* are arranged adjacent to the liquid spraying head unit 7 on both sides thereof. In this arrangement, the ultraviolet radiation head unit 8*a* is provided on the left side of the liquid spraying head unit 7 in FIG. 2, and the ultraviolet radiation head unit 8*b* is provided on the right side of the light spraying head unit 7 in FIG. 2.

A plurality of nozzles is formed on the underside of the liquid spraying head unit 7 in FIG. 2, i.e., the side facing the printing medium 1, in the conveyance direction of the printing medium 1, i.e., the direction orthogonal to the movement direction of the liquid spraying head unit 7, for example, so as to form a nozzle row, and a nozzle actuator is provided to each of the nozzles.

The nozzle actuators include, for example, piezoelectric elements that are used for spraying the liquid in the nozzles from the nozzles. The nozzle actuators are each driven so as to draw the liquid into the nozzles, and then eject the liquid from the nozzles so as to spray the liquid from the nozzles.

Dots of the liquid of various sizes can be formed on the printing medium 1 by varying the intake method and amount of liquid drawn in, and the ejection method and amount of liquid ejected. The size of the dots is controlled by a host computer not shown in the drawing.

In this embodiment, an ultraviolet-curable liquid (photo-curable liquid) is preferably sprayed from the nozzles in the liquid spraying head unit 7 to the printing medium 1.

The ultraviolet radiation head units 8*a*, 8*b* have an identical structure. The undersides of the ultraviolet radiation head units 8*a*, 8*b* in FIG. 2, i.e., the surfaces facing the printing medium 1, form ultraviolet radiating surfaces, from which ultraviolet rays (curing light rays) are radiated toward the printing medium 1.

For example, when the liquid spraying head unit 7 moves together with the carriage 6 from the right side to the left side in FIG. 2, for example, the nozzle actuator of the nozzle passing over a prescribed printing position of the printing medium 1 is driven to spray the ultraviolet-curable liquid from the nozzle to the prescribed printing position of the printing medium 1. Then, the ultraviolet rays are radiated from the ultraviolet radiation head unit 8*b*, which is positioned to the right of the liquid spraying head unit 7, toward the ultraviolet-curable liquid that has been sprayed onto the printing medium 1. Thus, the irradiated ultraviolet-curable liquid is cured and fixed to the printing medium 1. Accordingly, blur-resistant, peel-resistant printing is made possible.

On the other hand, when the liquid spraying head unit 7 moves together with the carriage 6 from the left side to the right side in FIG. 2, the nozzle actuator of the nozzle passing over a prescribed printing position of the printing medium 1 is driven, and the ultraviolet-curable liquid is sprayed from the nozzle to the prescribed printing position of the printing medium 1. Then, the ultraviolet rays are radiated from the ultraviolet radiation head unit 8*a*, which is positioned to the left of the liquid spraying head unit 7, toward the ultraviolet-curable liquid that has been sprayed onto the printing medium 1.

The printing medium 1 is thereby printed in conjunction with the left-right reciprocal movement of the liquid spraying head unit 7.

The ultraviolet radiation head units 8*a*, 8*b* are controlled by a host computer not shown in the drawing, and the radiation timing of the ultraviolet radiation head units 8*a*, 8*b* is controlled in accordance with the travel direction of the liquid spraying head unit 7 and the spray timing of the ultraviolet-curable liquid from the liquid spraying head unit 7.

A case in which two ultraviolet radiation head units 8*a*, 8*b* are provided was described above, but the present invention can be applied even when a single ultraviolet radiation head unit 8 is provided. In this case, the ultraviolet radiation head unit 8 may be provided on the right side or the left side of the liquid spraying head unit 7 so that the ultraviolet radiation head unit 8 passes over after the ultraviolet-curable liquid has been sprayed by the liquid spraying head unit 7, according to the printing direction of the liquid spraying head unit 7.

Figure 3:
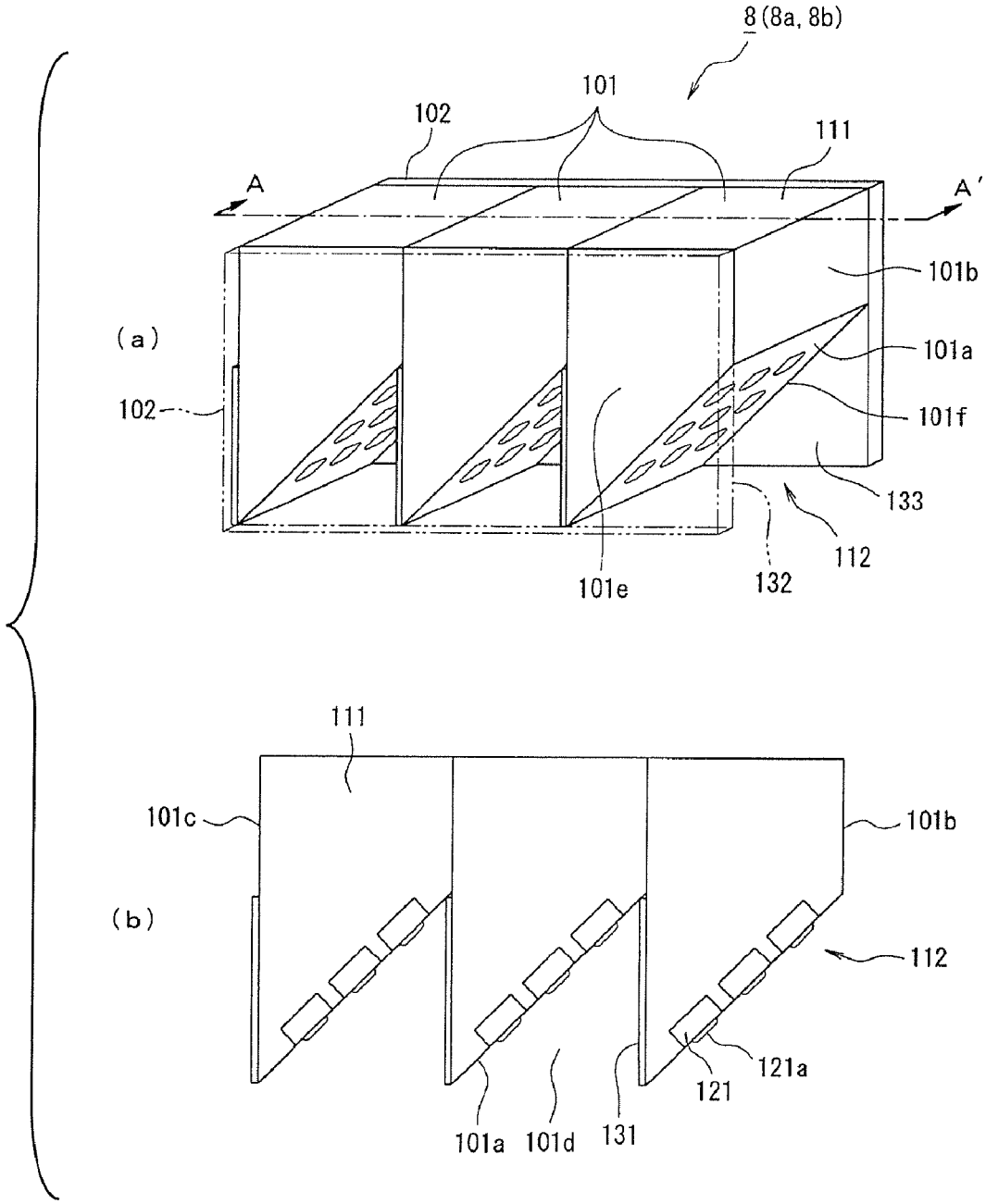
FIG. 3 includes a diagram (a) showing an enlarged schematic perspective view of an ultraviolet radiation head unit of the printing device, and a diagram (b) showing a schematic cross sectional view of the ultraviolet radiation head unit of the printing device as taken along a section line A-A' in the diagram (a) in accordance with the first embodiment of the present invention.

FIG. 3 includes a diagram (a) showing an enlarged schematic perspective view of the ultraviolet radiation head unit 8*a*, 8*b* of the printing device, and a diagram (b) showing a schematic cross sectional view of the ultraviolet radiation head unit 8*a*, 8*b* of the printing device as taken along a section line A-A' in the diagram (a) in accordance with the first embodiment. Since the ultraviolet radiation head units 8*a*, 8*b* have the same structure, the ultraviolet radiation head units 8*a* and 8*b* are collectively referred as the ultraviolet radiation head unit 8 in the following description.

The ultraviolet radiation head unit 8 has a plurality of ultraviolet radiation heads 101 (rectangular parallelepiped members) (e.g., three ultraviolet radiation heads in FIG. 3) having the same structure. The ultraviolet radiation heads 101 is integrally fixed by a fixing member 102 (housing) to form a single light source as the ultraviolet radiation head unit 8.

The ultraviolet radiation heads 101 each includes a radiation mechanism 112 and a cooling mechanism 111 such as a heat sink.

The cooling mechanism 111 has a pointed incisor tooth shape having a sharp corner at the bottom part as shown the cross sectional view in FIG. 3. More specifically the cooling mechanism 111 is a generally vertically elongated rectangular parallelepiped in which, for example, the right lower part in FIG. 3(*a*) is cut off at an angle from slightly above the center of the right-side surface to the corner formed by the left-side surface and the bottom surface.

The radiation mechanism 112 includes a plurality of light emitting elements 121 and a plurality of refractors 131, 132 and 133 such as reflecting mirrors.

The light emitting elements 121 are arranged in rows in a light emitting element arrangement surface 101*a* of the cooling mechanism 111, which is the tilted surface formed by the inclined cut-off surface. The light emitting elements 121 are arranged in rows of three each, for example, vertically and horizontally as shown in FIG. 3(*a*).

Although, in the illustrated embodiment, the light emitting elements 121 are arranged in rows of three each vertically and horizontally in FIG. 3(*a*), the arrangement of the light emitting elements 121 are not limited to the illustrated embodiment. Any number of light emitting elements 121 may be arranged, a zigzag arrangement or concentric circle arrangement may be used instead of a vertical and horizontal row arrangement, and any arrangement method may be used.

The light emitting elements 121 are, for example, surface-mounted ultraviolet emitting elements (UVLED: Ultra Violet Light Emitting Diode). More specifically, each of the light emitting elements 121 has a substantially rectangular block shape in which one end surface thereof is a light emitting surface having a convex emitting part 121*a* as shown in FIG. 3(*b*). The light emitting elements 121 are preferably embedded in the cooling mechanism 111 so that the position of the light emitting surface and the position of the light emitting element arrangement surface 101*a* are at approximately the same level.

Each of the reflectors 131 is arranged on an opposing surface 101*c* (second side surface), which is disposed on an opposite side from a cut side surface 101*b* (first side surface) (remaining surface on the side of each cooling mechanism 111 from which the lower part was cut off) with respect to the light emitting element arrangement surface 101*a*. The reflectors 131 are arranged on the outsides of the opposing surfaces 101*c*. Therefore, when two ultraviolet radiation heads 101 are connected so that the cut side surface 101*b* of one ultraviolet radiation head 101 is adjacent to the opposing surface 101*c* of the other ultraviolet radiation head 101, the reflectors 131 face the spaces 101*d* formed below the cut side surfaces 101*b* between the two ultraviolet radiation heads 101.

As shown in FIG. 3(*a*), the reflectors 132, 133 are also arranged on the unit fixing member 102 to face toward the spaces 101*d*.

More specifically, the unit fixing member 102 has a generally rectangular box shape in which one surface (bottom surface) is open. The unit fixing member 102 is preferably made of the same material as the cooling mechanism 111, or of material having a high thermal conductivity such as aluminum or the like. Alternatively, instead of using the rectangular box shape member, the unit fixing member 102 can be formed by a pair of fixing plates that is configured and arranged to fixedly hold the ultraviolet radiation heads 101 therebetween.

The unit fixing member 102 is fixedly coupled to a pair of fixed side surfaces 101*e* and 101*f* disposed between the cut side surface 101*b* and the opposing surface 101*c* of the ultraviolet radiation head 101. The unit fixing member 102 is configured and arranged to retain a prescribed number (e.g., three in this example) of the ultraviolet radiation heads 101 that are fitted together by accommodating the fixed side surfaces 101*e* and 101*f* of the ultraviolet radiation heads 101 in a state in which the cut side surface 101*b* of one of the ultraviolet radiation heads 101 is adjacent to the opposing surface 101*c* of the adjacent ultraviolet radiation head 101. In the illustrated embodiment, the fixed side surfaces 101*e* and 101*f* of the three ultraviolet radiation heads 101 are each accommodated by the unit fixing member 102, whereby the three ultraviolet radiation heads 101 are fitted together and retained by the unit fixing member 102 in an integrally fixed configuration.

When the three ultraviolet radiation heads 101 are fixed by the unit fixing member 102 in a state in which the cut side surface 101*b* of one of the ultraviolet radiation heads 101 is adjacent to the opposing surface 101*c* of the adjacent ultraviolet radiation head 101, the reflectors 132 and 133 are arranged in the portions of the unit fixing member 102 that do not overlap the fixed side surfaces 101*e* and 101*f*. In the cross-sectional view shown in FIG. 3(*b*) as taken along the section line A-A' in FIG. 3(*a*), the reflectors 132 and 133 are arranged in the right-triangular regions corresponding to the cut off empty spaces 101*d* below the cut side surfaces 101*b* of the ultraviolet radiation heads 101.

When the ultraviolet radiation heads 101 are fixed by the unit fixing member 102 in a state in which the three ultraviolet radiation heads 101 are arranged so that the cut side surface 101*b* of one of the ultraviolet radiation heads 101 is adjacent to the opposing surface 101*c* of the adjacent ultraviolet radiation head 101, the space 101*d* that is open at the bottom is formed between the bottom of the cut side surface 101*b* of one ultraviolet radiation head 101 and the opposing surface 101*c* of the next ultraviolet radiation head 101, and surrounded by the light emitting element arrangement surface 101*a* of the ultraviolet radiation head 101, the reflector 131 provided to the opposing surface 101*c* (refractor arrangement surface) of the adjacent ultraviolet radiation head 101, and the reflectors 132 and 133 provided to the inner surfaces of the unit fixing member 102 as shown in FIG. 3(*b*).

Figure 4:
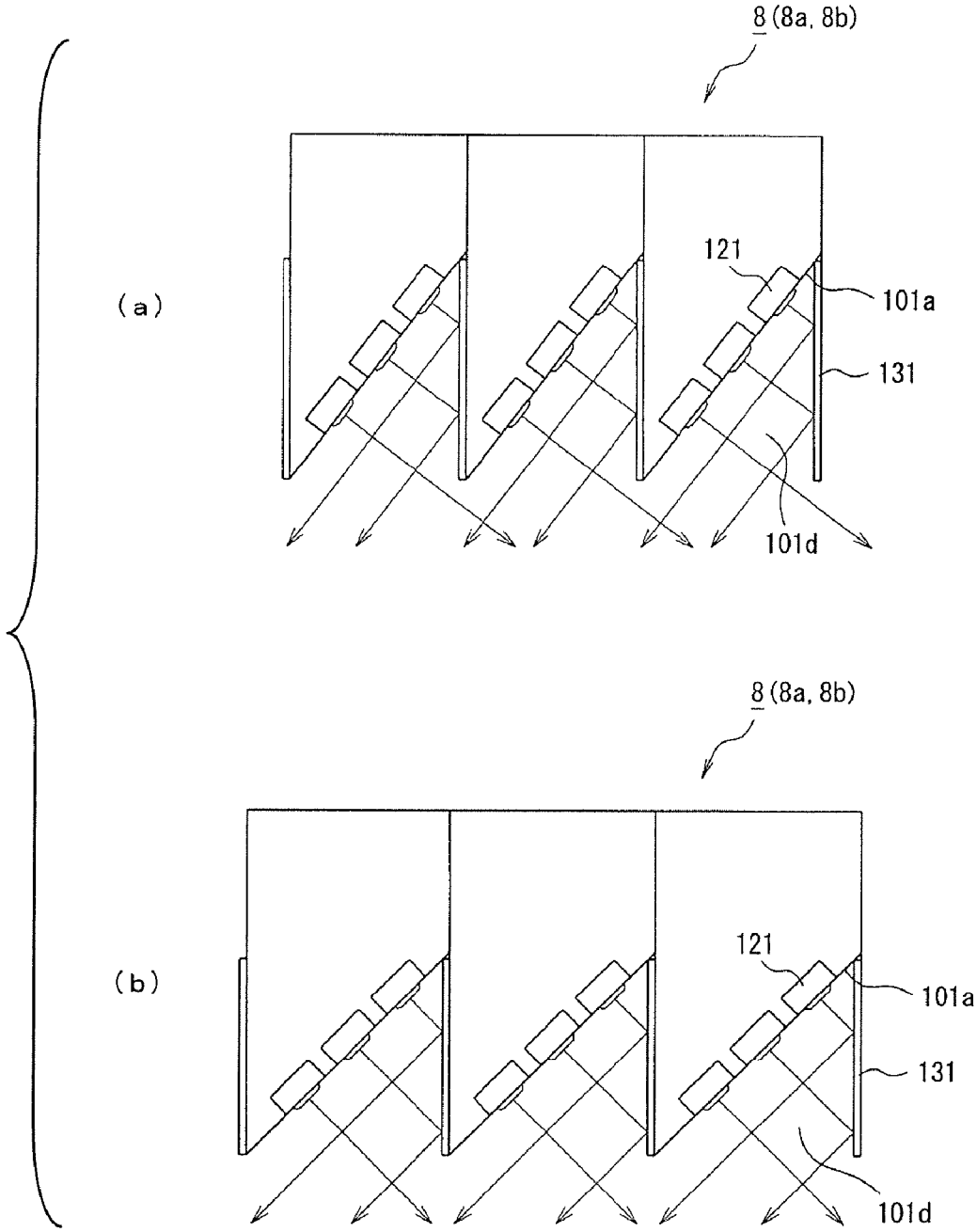
FIG. 4 includes schematic cross sectional views (a) and (b) showing relationships between an orientation of a light emitting element arrangement surface, an irradiated area, and a light intensity in accordance with the first embodiment of the present invention.

The open part of the space 101*d* forms an emission part. As shown in FIG. 4(*a*), the light emitted from the light emitting elements 121 arranged in the light emitting element arrangement surface 101*a* is directly emitted to the outside from the open part of the space 101*d*, or is incident on the reflectors 131, 132, and 133 and is emitted to the outside from the open part after being reflected by the reflectors 131, 132, and 133.

Consequently, by adjusting the tilt angle of the light emitting element arrangement surface 101*a* and the arrangement positions of the light emitting elements 121, it is possible to adjust the radiation area or the light intensity that is emitted directly to the outside from the light emitting elements 121 through the open parts of the ultraviolet radiation heads 101, as well as the intensity, radiation area, and other characteristics of the part of the light emitted from the light emitting elements 121 that is reflected by the reflectors 131 through 133 and emitted to the outside through the open parts.

For example, since the light emitting elements 121 and the reflectors 131 through 133 have different relative positions when the light emitting element arrangement surface 101*a* has a different tilt angle, as shown in FIGS. 4(*a*) and 4(*b*), different intensities of light are incident on the reflectors 131 through 133 from the light emitting elements 121, and the area irradiated by the ultraviolet radiation head unit 8 varies. Therefore, the desired surface area can be irradiated by the desired amount of light by setting the tilt angle of the light emitting element arrangement surface 101*a* and the arrangement positions of the light emitting elements 121 while taking into account the relationship between the light emitting elements 121 and the reflectors 131, 132, and 133, the amount of radiated light, and the radiation area.

Figure 5:
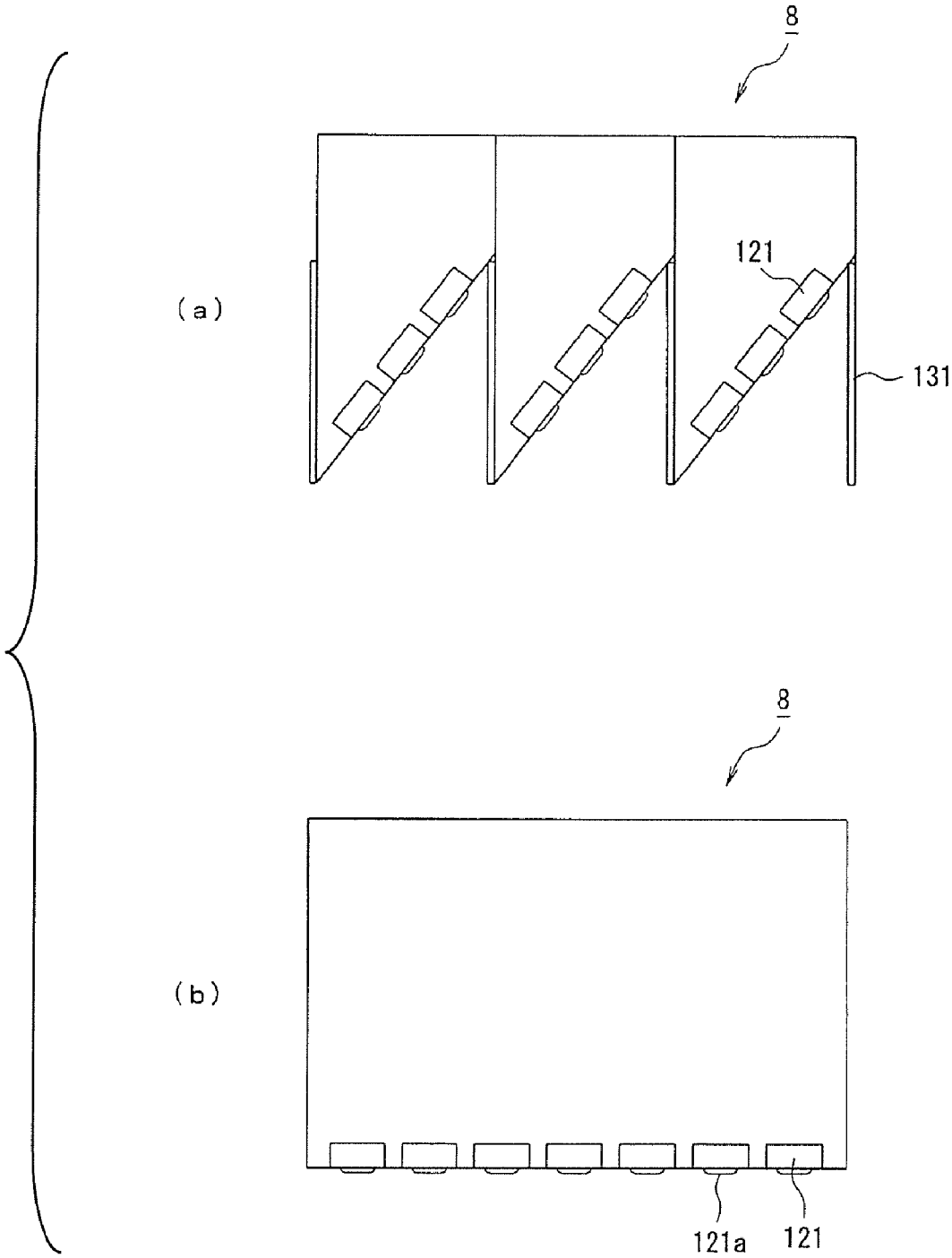
FIG. 5 includes a diagram (a) showing a schematic cross sectional view of the ultraviolet radiation head unit in which the light emitting elements are arranged on a tilted surface in accordance with the first embodiment, and a diagram (b) showing a schematic cross sectional view of an ultraviolet radiation head unit in which the light emitting elements are arranged on a horizontal surface in accordance with a comparative example.

In a case in which the light emitting elements 121 at the bottom of the ultraviolet radiation head unit 8 are arranged so that the emitting part 121*a* extend generally parallel to the irradiated object, and the irradiated object is directly irradiated by the light emitted from the light emitting elements 121 as a comparison example shown in FIG. 5(*b*), it is only possible to arrange a prescribed number of light emitting elements 121 that can be arranged in a prescribed plane, which is determined according to the surface area of the light emitting elements 121 in the prescribed plane.

However, when a configuration is adopted in which the light emitting elements 121 are arranged in the light emitting element arrangement surface 101*a* that is tilted with respect to the irradiated object, and the light reflected by the reflectors 131 through 133 is radiated to the reflected object, as shown in FIGS. 3(*a*) and 3(*b*), the light emitting elements 121 can be arranged not only within a plane, but also in the height direction of the ultraviolet radiation heads 101, as shown in FIG. 5(*a*). It is therefore possible to arrange a larger number of light emitting elements 121 than can be arranged when the light emitting elements 121 are arranged on the bottom of the ultraviolet radiation head unit 8 as in the comparison example in FIG. 5(*b*).

Consequently, even when the light emitting elements 121 are arranged in the same space, arranging the light emitting elements 121 in the light emitting element arrangement surface 101*a* that is tilted with respect to the irradiated object makes it possible to arrange more light emitting elements 121 than can be arranged when the light emitting elements 121 are arranged with respect to the irradiated object so that the emitting part 121*a* and the irradiated object extend parallel to each other. Therefore, the emitted light intensity per unit area can be further increased in the illustrated embodiment.

The light emitting elements 121 can therefore be arranged at a higher density in a limited space, and a larger amount of light can be emitted. Consequently, the ultraviolet-curable liquid that has been sprayed onto the printing medium 1 can be irradiated by an adequate intensity of ultraviolet rays, and the ultraviolet-curable liquid can be adequately cured.

In other words, since the ultraviolet radiation head unit 8 can be reduced in size without changing the intensity of emitted light, it is possible to reduce the overall size of the printing device 100 in which the ultraviolet radiation head units 8 (8*a*, 8*b*) are mounted to the carriage 6.

As described above, the ultraviolet radiation head unit 8 includes the multiple ultraviolet radiation heads 101 having the same structure that is fixed together. Therefore, the ultraviolet radiation head unit 8 that is capable of irradiating the desired irradiation area can easily be obtained by adjusting the number of the ultraviolet radiation heads 101.

Since the ultraviolet radiation head unit 8 can be disassembled into the individual ultraviolet radiation head 101, installation, removal, and other maintenance of the light emitting elements 121 can easily be performed.

Since the light emitting elements 121, which are heat sources, are embedded in the cooling mechanism 111 as shown in FIGS. 3(*a*) and 3(*b*), the light emitting elements 121 can be cooled not only from the back surfaces thereof, but also from the side surfaces thereof. Therefore, the light emitting elements 121 can be cooled with enhanced efficiency.

Embedding the light emitting elements 121 in the cooling mechanism 111 makes it possible to reliably fix the light emitting elements 121 in place, and the amount of device-occupied space can be commensurately reduced; i.e., the size of the device can be reduced. Since the light emitting elements 121 are embedded in the cooling mechanism 111, it is possible to reduce the risk of damage to the light emitting elements 121 by unintended contact of the printing medium 1 with the light emitting elements 121 or other causes during such functions as conveyance of the printing medium 1.

As shown in FIGS. 3(*a*) and 3(*b*), since the area below the cut side surface 101*b* in each of the ultraviolet radiation heads 101 is open, the light emitting elements 121 can easily be arranged even when the light emitting elements 121 are arranged in an upper portion of the light emitting element arrangement surface 101*a*, and maintenance and the like of the light emitting elements 121 is facilitated.

Since the unit fixing member 102 is made of the same material as the cooling mechanism 111, or of material having a high thermal conductivity, not only can the light emitting elements 121 be cooled, but also the reflectors 132, 133 can be cooled. Thus, the temperature in the space surrounded by the light emitting elements 121 and the reflectors 131 through 133 can be prevented from increasing.

When the reflector 131 is provided to the opposing surface 101*c* as shown in FIG. 3(*b*), there is no ultraviolet radiation head 101 adjacent to the ultraviolet radiation head 101 on one end (the unit farthest to the right in FIG. 3) among the plurality of the ultraviolet radiation heads 101 fixed by the unit fixing member 102, and there is therefore no reflector 131 for reflecting the emitted light of the end unit.

Therefore, the ultraviolet radiation head 101 positioned at the end (the unit farthest to the right in FIG. 3) may be treated as a unit that does not contribute as a light source for ultraviolet radiation, or a configuration may be adopted in which the light emitting element arrangement surface 101*a* extends parallel to the printing medium 1 so that the printing medium 1 is directly irradiated by the light emitting elements 121. A configuration may also be adopted in which the reflector 131 is positioned between the sides of the unit fixing member 102 so as to cover the space below the cut side surface 101*b* disposed at one end of the ultraviolet radiation head unit 8.

First Modified Examples of First Embodiment

In the first embodiment as described above, the ultraviolet radiation heads 101 are fixed in an arrangement in which the cut side surface 101*b* of one of the ultraviolet radiation heads 101 is adjacent to the opposing surface 101*c* of the adjacent ultraviolet radiation head 101 to form the ultraviolet radiation head unit 8. However, the arrangement of the ultraviolet radiation heads 101 is not limited to the arrangement in the illustrated embodiment.

For example, the ultraviolet radiation head units 8 (8*a*, 8*b*) may be formed by connecting two ultraviolet radiation heads 101, which are fixed by the unit fixing member 102 in an arrangement in which the cut side surface 101*b* of one of the ultraviolet radiation heads 101 is adjacent to the opposing surface 101*c* of the adjacent ultraviolet radiation heads 101 to form a unit, then connecting a plurality of such units so that the unit fixing members 102 are adjacent to each other.

Figure 6:
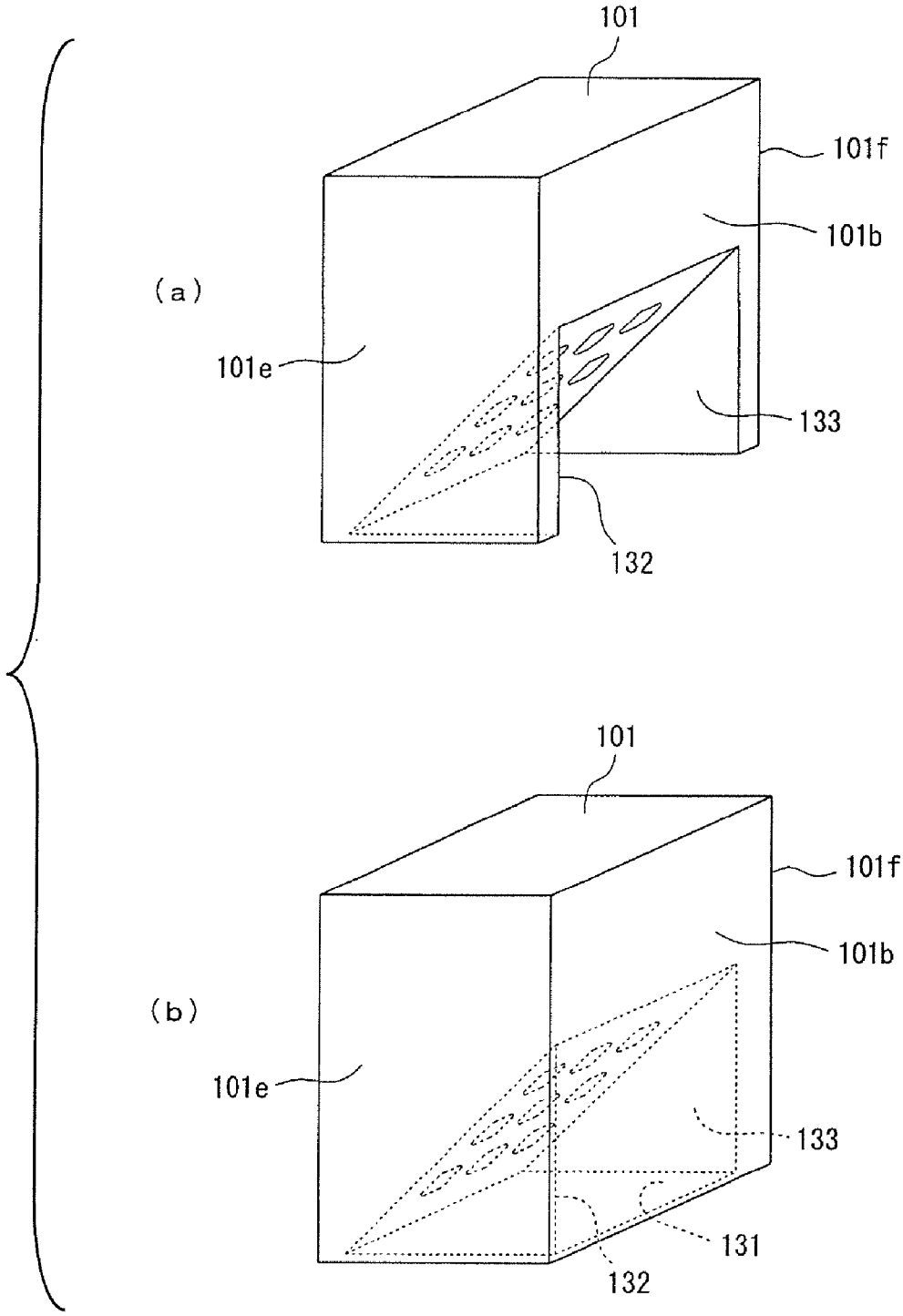
FIG. 6 includes diagrams (a) and (b) showing schematic perspective views of ultraviolet radiation heads in accordance with modified examples of the first embodiment.

Moreover, in the first embodiment as described above, the ultraviolet radiation heads 101 are fixed by the unit fixing member 102. However, the arrangement of the ultraviolet radiation heads 101 is not limited to the arrangement in the illustrated embodiment. For example, as shown in FIG. 6(*a*), a ultraviolet radiation head 101 may be formed having a shape in which the side surfaces corresponding to the side surfaces 101*e* and 101*f* of the rectangular parallelepiped cooling mechanism 111 are not removed, but are allowed to remain, and the lower part of the cooling mechanism 111 is hollowed out at an angle from the cut side surface 101*b*. In such a case, the reflectors 132 and 133 may be provided to inner surfaces of the wall-shaped members (second reflecting surfaces) formed by the side surfaces 101*e* and 101*f*.

When the reflectors 132 and 133 are thus provided to the inner surfaces of the ultraviolet radiation head 101, the units do not necessarily need to be fixed by the unit fixing member 102, and the adjacent ultraviolet radiation heads 101 may simply be attached to each other by a fixing member or the like.

As shown in FIG. 6(*b*), the ultraviolet radiation head unit 8 may be formed by arranging the ultraviolet radiation heads 101 so that the lower part of the cut side surface 101*b* is not removed, all four side surfaces of the ultraviolet radiation heads 101 are allowed to remain, the rectangular parallelepiped cooling mechanism 111 has a recess extending from the bottom and the light emitting element arrangement surface (tilted surface) 101*a* is formed in the inside thereof. In such a case, the reflector 131 provided to the opposing surface 101*c* in the first embodiment may be provided to an inner surface of the wall-shaped member (first reflecting surface) formed at the bottom of the cut side surface 101*b*, and the reflectors 132 and 133 may be provided to inner surfaces of the wall-shaped members (second reflecting surfaces) formed by the side surfaces 101*e* and 101*f*. In such a case, the reflectors 131 through 133 are provided in each individual ultraviolet radiation head 101. In this case, an ultraviolet radiation head unit 8 can be formed using only a single ultraviolet radiation head 101.

Second Modified Examples of First Embodiment

In the first embodiment as described above, the light emitting element arrangement surface 101*a* is provided to form the hypotenuse of the right-triangle-shaped space 101*d*, as shown in the cross sectional view of FIG. 3(*b*), and the reflector 131 is provided to form the vertical side of the right triangle. However, the arrangement of the ultraviolet radiation heads 101 is not limited to the arrangement in the illustrated embodiment.

Figure 7:
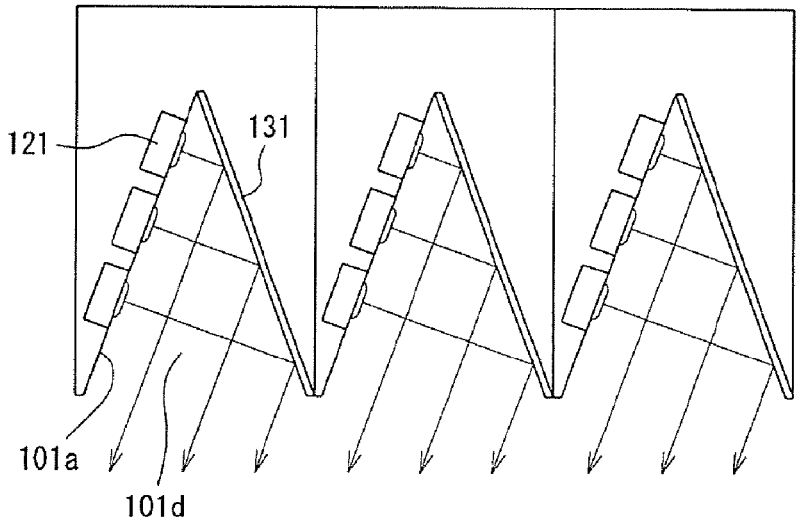
FIG. 7 is a schematic cross sectional view of an ultraviolet radiation head unit in accordance with a modified example of the first embodiment of the present invention.

For example, as shown in the cross sectional view of FIG. 7, a configuration may be adopted in which the space 101*d* is shaped so that the cross-section of the space 101*d* forms a substantially isosceles triangle. In such a case, the light emitting elements 121 are arranged on one of the two mutually opposing surfaces, and the reflector 131 is provided to the other of the two mutually opposing surfaces.

A configuration may also be adopted in which the arrangement positions of the light emitting elements 121 and the reflector 131 shown in FIG. 3 are reversed, the reflector is provided to the surface on the tilted side (hypotenuse) of the right triangle forming the space 101*d*, and the light emitting element arrangement surface is provided to the vertical side of the right triangle. In short, any arrangement may be used insofar as the light emitted from the light emitting elements 121 can be reflected toward the irradiated object by the reflector 131.

Figure 8:
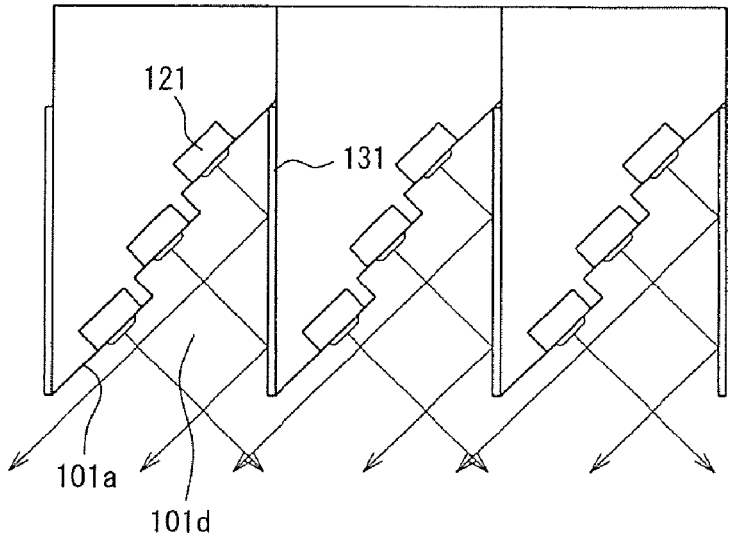
FIG. 8 is a schematic cross sectional view of an ultraviolet radiation head unit in accordance with a modified example of the first embodiment of the present invention.

In the first embodiment, a case was described in which the light emitting elements 121 are arranged in rows in the light emitting element arrangement surface 101*a* formed by a flat surface. However, the entire surface of the light emitting element arrangement surface 101*a* is not necessarily a flat surface, and the present invention can be applied even when flat surfaces are formed in steps as shown in FIG. 8, for example.

Since the optical path can be substantially radial or directed in a specific direction depending on the radiation direction, arrangement, or other characteristics of the light emitting elements 121, or the type of members used as the light emitting elements 121, the reflectors 132 and 133 provided to the unit fixing member 102 may be arranged according to the optical path of the light emitted from the light emitting elements 121.

Third Modified Example of First Embodiment

In the first embodiment as described above, the surface-mounted UVLED elements are used as the light emitting elements 121. However, the light emitting elements 121 are not limited to the surface-mounted UVLED elements, and any elements may be used insofar as the light emitting bodies are capable of emitting light to cause the ultraviolet-curable liquid to cure.

In the first embodiment as described above, the ultraviolet-curable liquid is used for printing. However, the printing device of the illustrated embodiments can also be applied when printing is performed using a photo-curable liquid having the characteristic of being cured by irradiation by X-rays, visible light rays, infrared rays, electron rays, or other light rays. In this case, light emitting elements are used that emit light rays that are capable of curing the photo-curable liquid in accordance with the particular photo-curable liquid used.

Fourth Modified Examples of First Embodiment

In the first embodiment as described above, the light emitting elements 121 are embedded directly in the cooling mechanism 111. However, the mounting arrangement of the light emitting elements 121 is not limited to the arrangement in the illustrated embodiment.

For example, grease, sheet, or other heat dissipator having high thermal conductivity may be inserted between the light emitting elements 121 and the cooling mechanism 111. In such a case, cooling efficiency can be further enhanced by inserting the heat dissipator.

A fan or other cooling mechanism may also be separately provided, and the light emitting elements 121 may thereby be provided on the surface of the cooling mechanism 111 instead of being embedded in the cooling mechanism 111.

In the first embodiment as described above, the heat sink is used as the cooling mechanism 111. However, the cooling mechanism 111 is not limited to the heat sink. For example, a cooling mechanism formed by a metal, resin, or other material having high thermal conductivity may also be used, or an air or water cooling mechanism may be used.

The light emitting elements 121 are also not limited to being attached to the cooling mechanism 111, and a configuration may also be adopted in which the light emitting elements 121 are provided to a member other than the cooling mechanism 111 to form an ultraviolet radiation head unit 8. In this case, a fan or other cooling mechanism may be separately provided.

In the first embodiment as described above, the light emitting elements 121 correspond to the light emitting bodies, the reflector 131 corresponds to the reflector, and the reflectors 132 and 133 correspond to the auxiliary reflectors. The light emitting element arrangement surface 101*a* corresponds to the light source arrangement surface and the tilted surface, the portions of the unit fixing member 102 that face the space 101*d* correspond to third and fourth side surfaces, the opposing surface 101*c* corresponds to the second side surface, and the cooling mechanism 111 corresponds to the cooling mechanism.

Second Embodiment

Figure 9:
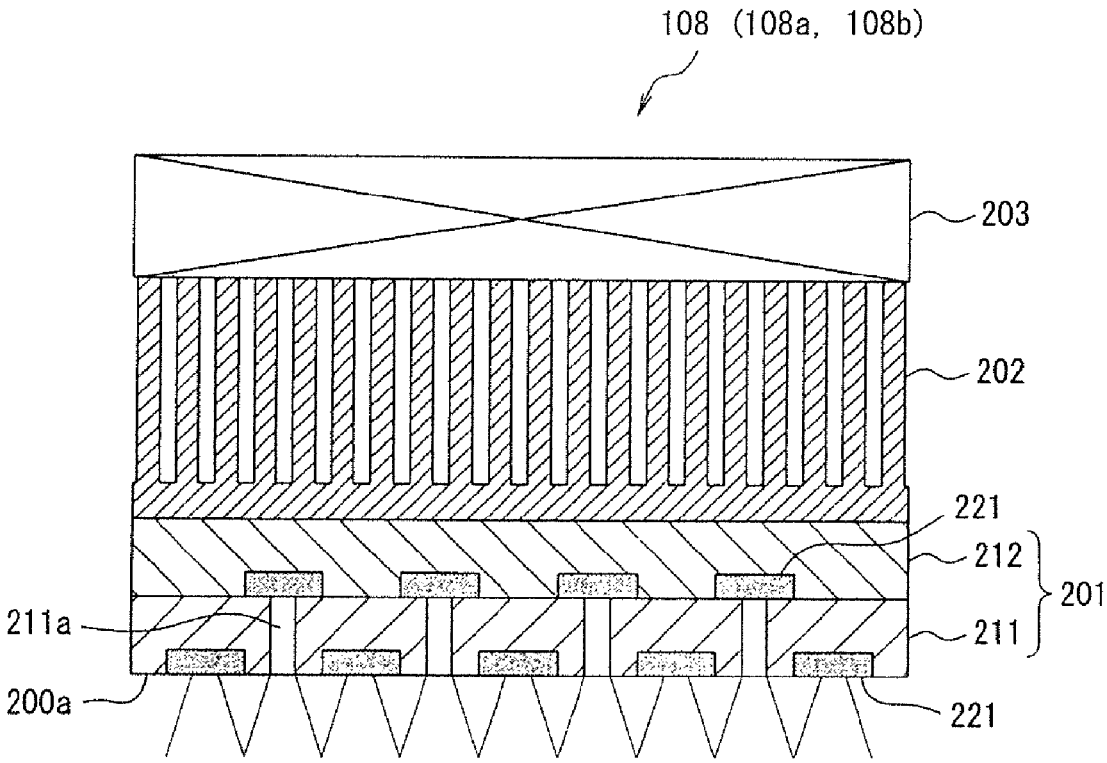
FIG. 9 is a schematic cross sectional view of an ultraviolet radiation head in accordance with a second embodiment.
Figure 10:
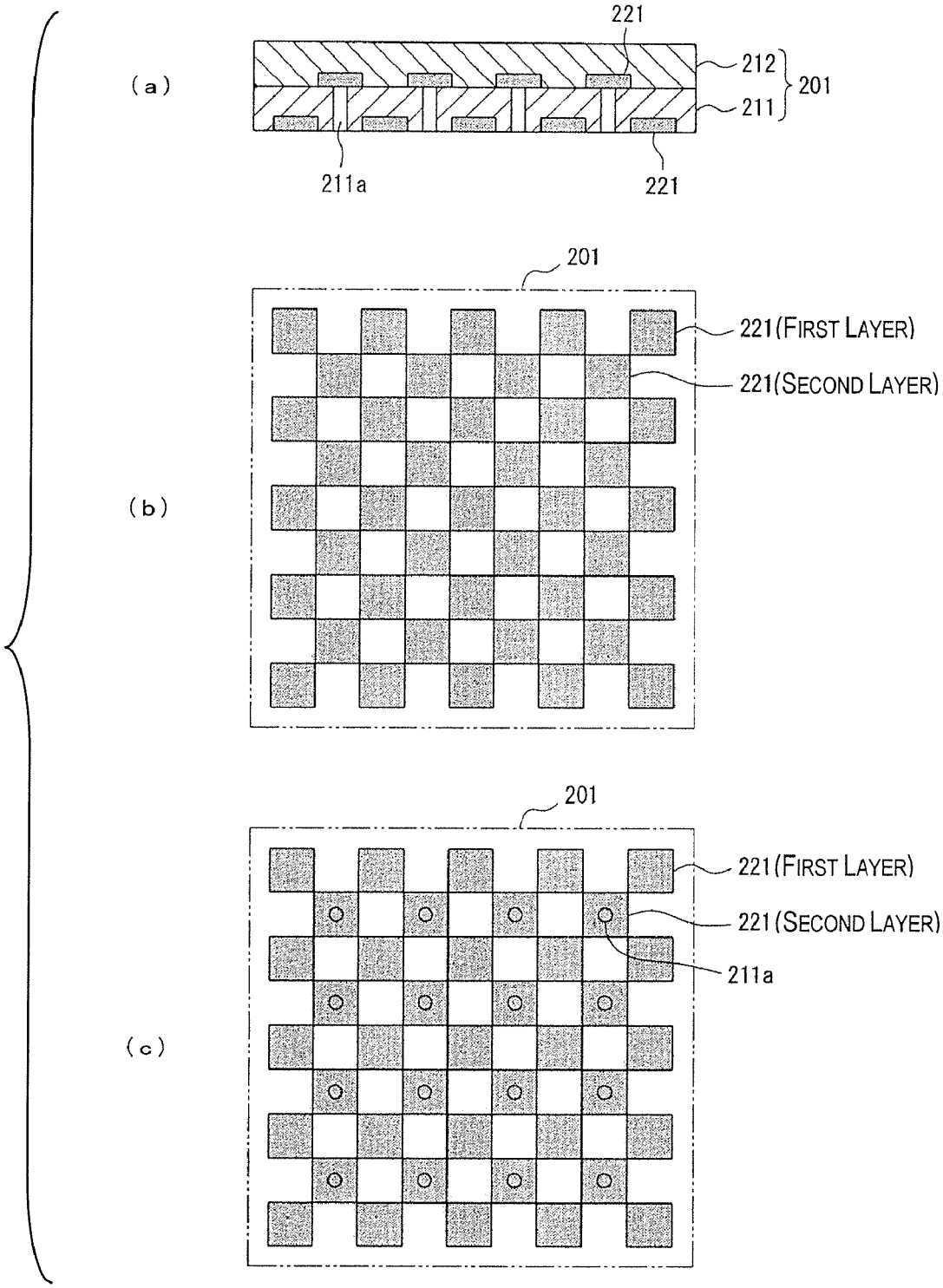
FIG. 10 includes a schematic cross sectional view (a) and a pair of plan views (b) and (c) of the ultraviolet radiation head showing an arrangement in which the light emitting elements are disposed in the ultraviolet radiation head illustrated in FIG. 9 in accordance with the second embodiment.

Referring now to FIGS. 9, 10(*a*) to 10(*c*), a printing device in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The printing device according to the second embodiment is the same as the first embodiment except that ultraviolet radiation head units 108*a*, 108*b* of the second embodiment have a different structure than the ultraviolet radiation head units 8*a*, 8*b* of the first embodiment. Since the structure of the ultraviolet radiation head unit 108*a* is identical to the structure of the ultraviolet radiation head unit 108*b*, the ultraviolet radiation head units 108*a*, 108*b* are collectively referred herein as the ultraviolet radiation head unit 108.

FIG. 9 is a schematic cross sectional view of the ultraviolet radiation head unit 108 in accordance with the second embodiment.

The ultraviolet radiation head unit 108 has a substantially rectangular block shape, and includes a base member 201, a heat sink 202 provided on the base member 201, and a fan 203 provided on the heat sink 202.

The base member 201 includes layered light source plates 211 and 212 having the same elongated rectangular plate shape. The surface of the light source plate 211 opposite the surface adjacent to the light source plate 212 forms the light emitting surface 200*a* of the ultraviolet radiation head unit 108. As shown in FIG. 9, a plurality of light emitting elements 221 is arranged in the light source plates 211 and 212 of the base member 201.

FIG. 10 includes diagrams (a) to (c) showing the state in which the light emitting elements 221 are arranged in the base member 201. More specifically, FIG. 10(*a*) is a schematic cross sectional view showing the base member 201, FIG. 10(*b*) is a diagram showing a plan view of the light emitting elements 221 arranged on the light source plates 211 and 212 as viewed from above the base member 201, and FIG. 10(*c*) is a diagram showing a plan view of the light emitting elements 221 arranged on the light source plates 211 and 212 as viewed from below the base member 201.

In the light source plate 211, the light emitting elements 221 are spaced apart at intervals of about the size of one light emitting element in the forward, backward, left, and right directions, as shown in FIGS. 10(*a*) to 10(*c*), for example.

The light emitting elements 221 are arranged in the same manner in the light source plate 212 as well, and these light emitting elements 221 are also spaced apart at intervals of about the size of one light emitting element. However, the light emitting elements 221 arranged in the light source plate 212 are disposed in the positions corresponding to the spaces between the light emitting elements 221 arranged in the light source plate 211 as viewed in a plan view, as shown in FIGS. 9 and 10(*a*) to 10(*c*). The light emitting elements 221 are thereby arranged in a zigzag lattice pattern (a checker board pattern) as viewed in a plan view so that the light emitting elements 221 are adjacent to each other at the corners thereof in the base member 201, as shown in FIGS. 10(*b*) and 10(*c*).

The light emitting elements 221 are preferably surface-mounted ultraviolet light emitting elements (UVLED: Ultra Violet Light Emitting Diode) or other ultraviolet light emitting elements having a flat light emitting surface, for example. The light emitting elements 221 have a substantially rectangular block shape in which one end surface thereof is a light emitting surface. The light emitting elements 221 are embedded in the light source plates 211 and 212 so that the light emitting surfaces of the light emitting elements 221 and the surfaces of the light source plates 211 and 212 are at approximately the same level.

A plurality of light guide paths 211*a* extending vertically through the light source plate 211, which is the first layer (bottom layer) of the layered structure, to the light emitting surface 200*a* are formed in positions corresponding to the light emitting surfaces of the light emitting elements 221 that are arranged in the light source plate 212, which is the second layer (upper layer), as shown in FIG. 9.

The light guide paths 211*a* and the light emitting surfaces of the light emitting elements 221 of the light source plate 212 thereby face each other when the light source plates 211 and 212 are layered together. Thus, the light emitted from the light emitting elements 221 of the light source plate 212 is guided through the light guide paths 211*a* to the light emitting surface 200*a*, and as a result, the light emitted from the light emitting elements 221 of the first-layer light source plate 211, and the light emitted from the light emitting elements 221 of the second-layer light source plate 212 are emitted from the light emitting surface 200*a*.

The heat sink 202 is layered on a surface of the light source plate 212 opposite from the surface adjacent to the light source plate 211, and the fan 203 is fixed to the heat sink 202.

In this arrangement, the light emitted from the light emitting elements 221 arranged in the light source plate 211 is emitted without modification as the emitted light of the ultraviolet radiation head unit 108 from the light emitting surface 200*a*. The light emitted from the light emitting elements 221 of the light source plate 212 that is layered on the light source plate 211 passes through the light source plate 211 via the light guide paths 211*a*, and is guided to and emitted from the light emitting surface 200*a*.

Consequently, the light emitted from the light emitting elements 221 arranged in the light source plate 211, and the light emitted from the light emitting elements 221 arranged in the light source plate 212 are emitted from the light emitting surface 200*a*.

When the light emitting elements 221 are used, the light emitting elements 221 need to be spaced apart from each other to a certain degree due to heat, routing of signal lines, and other factors. The area in which the light emitting elements 221 can be arranged therefore decreases in accordance with the spacing, and when the light emitting elements 221 are arranged in a limited plane such as a light source plate, the number of light emitting elements 221 that can be arranged in the light source plate is subject to certain limitations.

However, a configuration is adopted as described above in which the light source plates 211 and 212 in which a plurality of light emitting elements 221 is arranged are layered together, and the light emitted from the light emitting elements 221 arranged in both of the light source plates 211 and 212 is emitted from the light emitting surface 200*a* as the emitted light of the ultraviolet radiation head unit 8. The light emitting elements 221 are arranged in the light source plates 211 and 212 so that the light emitting elements 221 arranged in each light source plate complement each other.

Therefore, although an area is occupied by the base member 201 in the layering direction becomes relatively large, a larger number of light emitting elements 221 can be arranged within the limited area of the bottom of the light emitting surface 200*a* of the ultraviolet radiation head unit 108. Therefore, the light intensity per unit area of the light emitting surface 200*a* can be increased. Consequently, the intensity of light radiated to the ultraviolet-curable droplets that have been sprayed onto the printing medium 1 can be increased, and the ultraviolet-curable droplets can be adequately cured.

Since the light emitting elements 221 of the light source plate 212 are arranged so as to fill the spaces between the light emitting elements 221 arranged in the light source plate 211, light is radiated from light emitting elements 221 in a uniformly dispersed arrangement in the light emitting surface 200*a*. Therefore, uneven luminance in the light emitting surface 200*a* can be prevented, and substantially uniform luminance can be obtained.

Heat evolution must be taken into account particularly in the case of surface-mounted LED elements or the like. Because the heat sink 202 and the fan 203 are provided above the light source plate 212 as described above, the base member 201 is thereby cooled. Therefore, it is possible to prevent the temperature of the ultraviolet radiation head unit 108 from increasing.

By layering the light source plates 211 and 212 as described above, the light intensity can be increased without increasing the surface area of the light emitting surface 200*a*. In other words, since the desired light intensity can be obtained even when the surface area of the light emitting surface 200*a* is small, the size of the ultraviolet radiation head unit 108 can be reduced.

The spacing of the light emitting elements 221 in the light source plates 211 and 212 is also wider than when the light emitting elements 221 were arranged at the minimum necessary spacing in a single light source plate. Therefore, the light emitting elements 221 are easily cooled.

In the second embodiment as described above, the heat sink 202 and the fan 203 are provided as a cooling mechanism to the ultraviolet radiation head unit 108. However, both of these components are not necessarily needed, and a configuration in which any one of the heat sink 202 and the fan 203 is provided may also be adopted.

Third Embodiment

Figure 11:
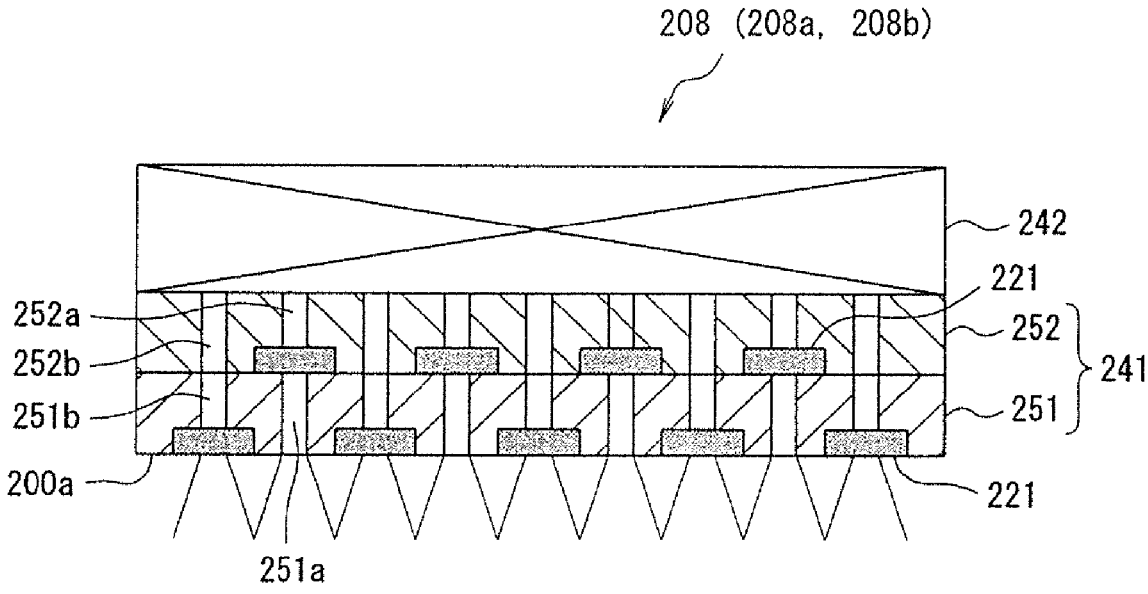
FIG. 11 is a schematic cross sectional view of an ultraviolet radiation head in accordance with a third embodiment.
Figure 12:
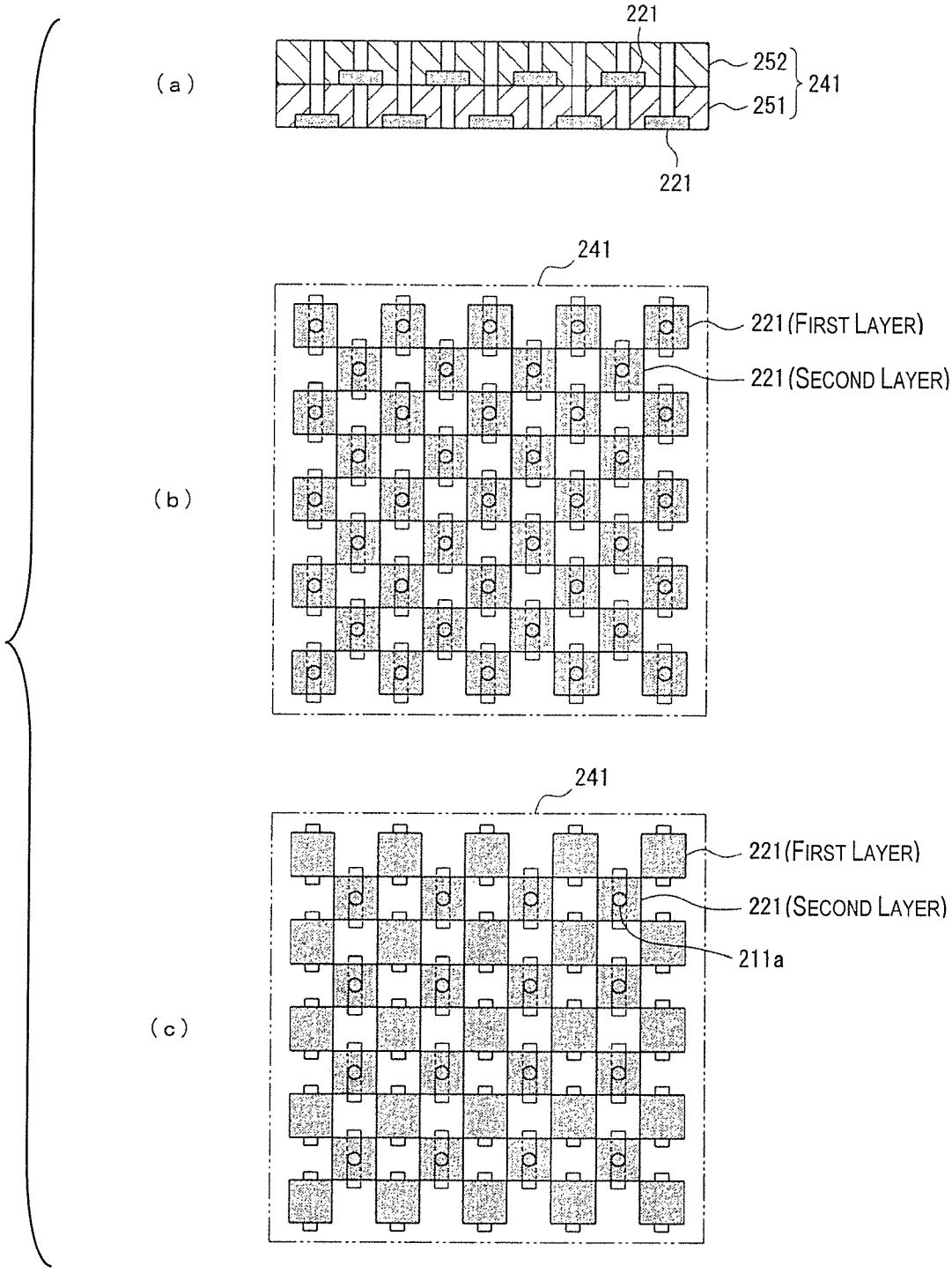
FIG. 12 includes a schematic cross sectional view (a) and a pair of plan views (b) and (c) of the ultraviolet radiation head showing an arrangement in which the light emitting elements are disposed in the ultraviolet radiation head illustrated in FIG. 11 in accordance with the third embodiment.

Referring now to FIGS. 11, 12(*a*) to 12(*c*) and 13(*a*) to 13(*c*), a printing device in accordance with a third embodiment will now be explained. In view of the similarity between the second and third embodiments, the parts of the third embodiment that are identical to the parts of the second embodiment will be given the same reference numerals as the parts of the second embodiment. Moreover, the descriptions of the parts of the third embodiment that are identical to the parts of the second embodiment may be omitted for the sake of brevity.

The printing device of the third embodiment is the same as the second embodiment except that a base member 241 of the third embodiment has a different structure from the base member 201 of the first embodiment.

Figure 13:
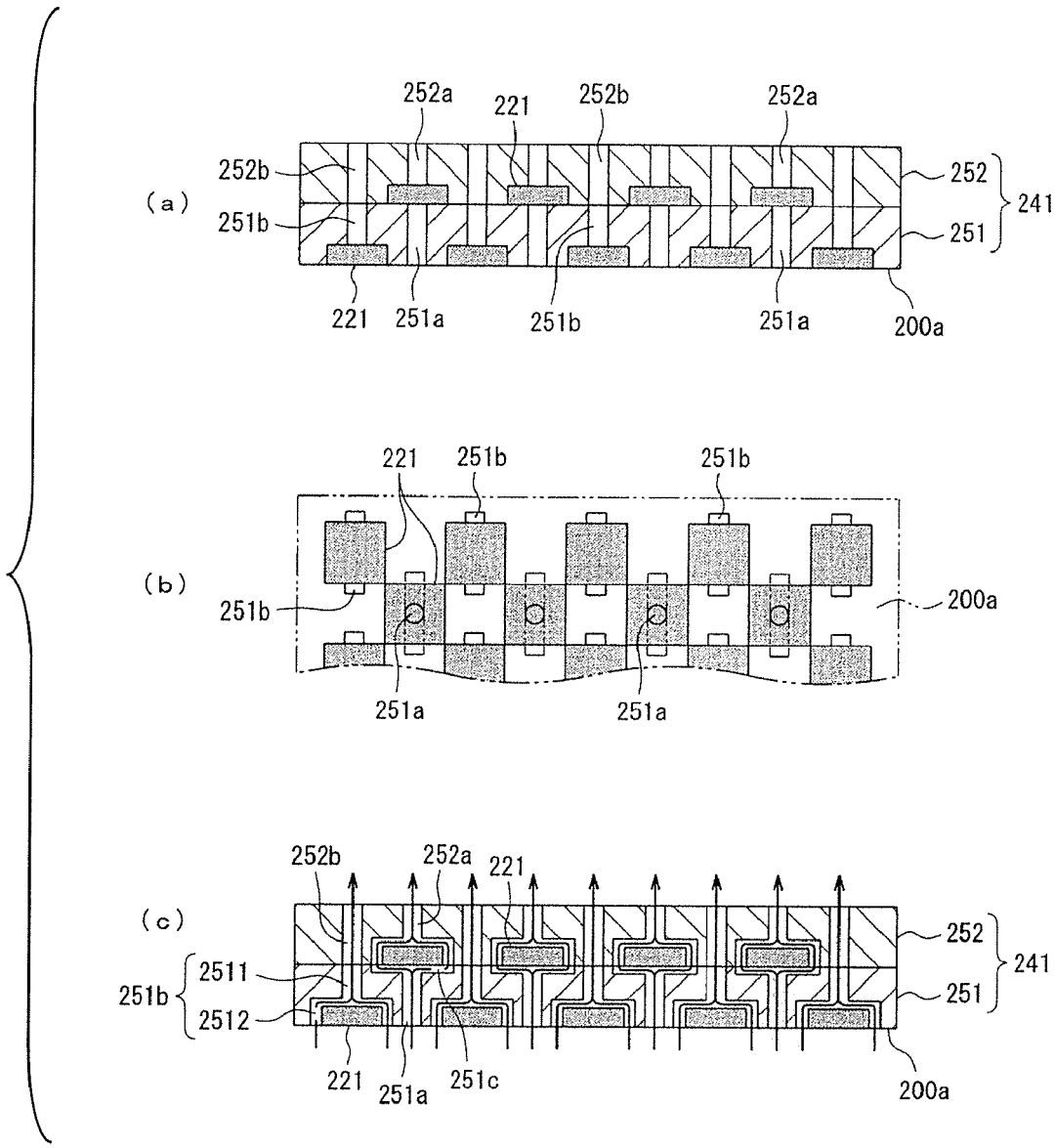
FIG. 13 includes a schematic cross sectional view (a), a partial plan view (b) and a schematic detailed cross sectional view (c) of an ultraviolet radiation head showing an arrangement of a plurality of ventilation paths provided in the ultraviolet radiation head in accordance with the third embodiment.

FIG. 11 is a schematic sectional view showing the structure of the ultraviolet radiation head unit 208 (208*a*, 208*b*) in the third embodiment. Since the structure of the ultraviolet radiation head unit 208*a* is identical to the structure of the ultraviolet radiation head unit 208*b*, the ultraviolet radiation head units 208*a*, 208*b* are collectively referred herein as the ultraviolet radiation head unit 208. FIG. 12 includes diagrams (a) to (c) showing the state in which the light emitting elements 221 are arranged in the base member 241 described hereinafter. More specifically, FIG. 12(*a*) is a schematic cross sectional view showing the base member 241, FIG. 12(*b*) is a diagram showing a plan view of the light emitting elements 221 of the layers as viewed from above the base member 241, and FIG. 12(*c*) is a diagram showing a plan view of the light emitting elements 221 of the layers as viewed from below the base member 241. FIG. 13 includes diagrams (a) to (c) showing a detailed view of a plurality of ventilation paths in the base member 241. More specifically, FIG. 13(*a*) is a cross sectional view from the front, FIG. 13(*b*) is a partial bottom plan view, and FIG. 13(*c*) is a cross sectional view from the side.

As shown in FIG. 11, the ultraviolet radiation head unit 208 in the third embodiment includes the base member 241, and a fan 242 (air-cooling mechanism) that is mounted on the base member 241.

The base member 241 includes layered light source plates 251 and 252 having the same elongated rectangular plate shape, and the surface of the light source plate 251 opposite the surface adjacent to the light source plate 252 forms the light emitting surface 200*a* of the ultraviolet radiation head unit 208.

In the light source plates 251 and 252, a plurality of light emitting elements 221 is arranged at predetermined intervals in the same manner as in the second embodiment described above, and the light emitting elements 221 in the light source plate 251 and the light emitting elements 221 in the light source plate 252 are spaced apart so as to be offset from each other, as shown in FIGS. 12(*a*) to 12(*c*).

As shown in FIG. 13(*a*), a plurality of light guide paths 25 la are formed in the light source plate 251 for guiding the light emitted from the light emitting elements 221 arranged in the light source plate 252 to the light emitting surface 200*a* of the ultraviolet radiation head unit 208. Furthermore, as shown in FIG. 13(*c*), a plurality of ventilation paths 251*b* are formed in the light source plate 251 that pass through from the surface adjacent to the light source plate 252 to the light emitting surfaces of the light emitting elements 221 via the light emitting elements 221 arranged in the light source plate 251, and a plurality of ventilation paths 251*c* that pass through light guide paths 251*a* are formed in the light source plate 251.

In the light source plate 252, a plurality of ventilation paths 252*a* are formed that pass through to the light emitting surfaces of the light emitting elements 221 via the light emitting elements 221 arranged in the light source plate 252, from the surface of the light source plate 252 opposite the surface adjacent to the light source plate 251. A plurality of ventilation paths 252*b* that extend vertically through the light source plate 252 are formed between the light emitting elements 221 arranged in the light source plate 252. The ventilation paths 252*b* are formed in positions that enable passage through the ventilation paths 251*b* formed in the light source plate 251 when the light source plates 251 and 252 are layered together as shown in FIG. 13(*c*).

Each of the ventilation paths 251*b* of the light source plate 251 includes a first ventilation path 2511 that extends vertically to the non-emitting surfaces of the light emitting elements 221 from the surface of the light source plate 251 adjacent to the light source plate 252, and a second ventilation path 2512 that communicates with the first ventilation path 2511 and opens at the light emitting surface 200*a*. The second ventilation paths 2512 are formed in positions so as not to impede wiring to the anode and cathode terminals of the light emitting elements 221.

For example, in the cross sectional view of FIG. 13(*a*) as viewed from the front, the near side of the drawing is defined as forward, and the far side of the drawing is defined as rearward, and the anode and cathode terminals are disposed on the left side and right side of the light emitting elements 221 in the drawing. In such a case, as shown in FIG. 13(*c*), the second ventilation paths 2512 are formed in positions facing the front and back surfaces (left side and right side in FIG. 13(*c*)) of the light emitting elements 221, along the sides of the light emitting elements 221 from the non-emitting surfaces of the light emitting elements 221 while avoiding the positions of wiring to the anode and cathode terminals.

The second ventilation paths 2512 are formed with a narrower width than the width of the front and rear side surfaces of the light emitting elements 221, and are formed in positions facing the vicinity of the center parts in the width direction of the front and rear side surfaces. One end of the second ventilation paths 2512 is communicated with the first ventilation paths 2511 on the side of the non-emitting surfaces of the light emitting elements 221, and the other end is formed so as to extend to the light emitting surface of the light source plate 251.

Therefore, the ventilation paths are formed that lead from the surface of the light source plate 251 adjacent to the light source plate 252 to the non-emitting surfaces of the light emitting elements 221 via the first ventilation paths 2511, then from the non-emitting surfaces of the light emitting elements 221 along the sides to the light emitting surface of the light source plate 251 via the second ventilation paths 2512.

As shown in FIG. 13(*c*), the ventilation paths 251*c* are formed in positions on the side of the light source plate 251 facing the front and rear positions in the front and rear direction of the light emitting elements 221 of the light source plate 252. The ventilation paths 251*c* are formed as trenches from the edges of the light guide paths 251*a* to positions somewhat farther than the sides of the light emitting elements 221 on the side of the opposing light source plate 252. The ventilation paths 251*c* are communicated with the ventilation paths 252*a* on the side of the light source plate 252 in positions facing the sides of the light emitting elements 221 on the side of the light source plate 252.

The ventilation paths 252*a* on the side of the light source plate 252 are formed in the same manner as the ventilation paths 251*b* of the light source plate 251, as shown in FIG. 13(*c*).

The ventilation paths 252*b* of the light source plate 252 are formed so as to pass through the light source plate 252 and extend vertically, and are communicated with the ventilation paths 251*b* of the light source plate 251 when the light source plates 251 and 252 are layered together, as shown in FIG. 13(*c*).

When the light source plate 251 and the light source plate 252 are layered together, the ventilation paths are thereby formed that run along the non-emitting surfaces and side surfaces of the light emitting elements 221 of the light source plate 252 via the ventilation paths 252*a* from the surface of the light source plate 252 on the opposite side from the surface adjacent to the light source plate 251, and pass through the light guide paths 251*a* from the ventilation paths 251*c* and through to the light emitting surface 200*a*.

The ventilation paths 252*b* of the light source plate 252 and the ventilation paths 251*b* of the light source plate 251 are communicated with each other, and the ventilation paths are formed that pass through the ventilation paths 252*b* and ventilation paths 251*b* from the surface of the light source plate 252 on the opposite side from the surface adjacent to the light source plate 251, and pass through to the light emitting surface 200*a* along the non-emitting surfaces and side surfaces of the light emitting elements 221 of the light source plate 251.

The operation of the third embodiment will next be described.

The light emitted from the light emitting elements 221 arranged in the light source plate 251 is emitted without modification as the emitted light of the ultraviolet radiation head unit 208 from the light emitting surface 200*a*, the same as in the second embodiment described above. The light emitted from the light emitting elements 221 of the light source plate 252 that is layered on the light source plate 251 passes through the light source plate 251 via the light guide paths 251*a* formed in the light source plate 251, and is guided to the light emitting surface 200*a* and emitted toward the printing medium 1.

As previously described, by layering the light source plates 251 and 252 together, ventilation paths are formed in the base member 241 that pass from the surface of the base member 241 on the side of the fan 242 to the light emitting surface 200*a*, and the ventilation paths are composed of the ventilation paths 252*b* of the light source plate 252 and the ventilation paths 251*b* of the light source plate 251. Therefore, when the fan 242 is an intake-type fan, operating the fan 242 causes air to flow from the ventilation paths 251*b* through the ventilation paths 252*b* and towards the fan 242 of the base member 241. Therefore, the non-emitting surfaces and side surfaces of the light emitting elements 221 of the light source plate 251 are cooled.

The ventilation paths that lead to the light emitting surface 200*a* from the surface of the base member 241 on the side of the fan 242 are formed in the base member 241, and the ventilation paths includes the ventilation paths 252*a* of the light source plate 252, and the ventilation paths 251*c* and light guide paths 251*a* of the light source plate 251. Therefore, operating the fan 242 causes air to flow toward the fan 242 of the base member 241 through the light guide paths 251*a*, the ventilation paths 251*c*, and the ventilation paths 252*a*, and the non-emitting surfaces and side surfaces of the light emitting elements 221 of the light source plate 252 are cooled.

Generally speaking, the efficiency of heat dissipation is adversely affected when the light emitting elements 221 are layered. However, because the light emitting elements 221 are cooled using ventilation paths and light guide paths as described above, the light emitting elements 221 can be effectively cooled, and the temperature can be prevented from increasing.

Efficient cooling is possible particularly because the ventilation paths lead to the non-emitting surfaces of the light emitting elements 221 and directly cool the light emitting elements 221.

Since the light guide paths 251*a* for guiding the light emitted from the light emitting elements 221 of the light source plate 252 to the light emitting surface 200*a* are used as ventilation paths, there is no need to provide separate ventilation paths, and a commensurate reduction of the size of the light source plates can be anticipated.

It is apparent that the same operational effects as those of the second embodiment can be obtained in the third embodiment.

First Modified Example of Second and Third Embodiments

In the second and third embodiments as described above, the light guide paths 211*a*, 251*a* are provided as a light guiding section, and the light emitted from the light emitting elements 221 arranged in the second-layer light source plate is guided to the light emitting surface 200*a* by the light guide paths. However, the arrangement of the light guiding section is not limited to the arrangement in the illustrated embodiments.

Figure 14:
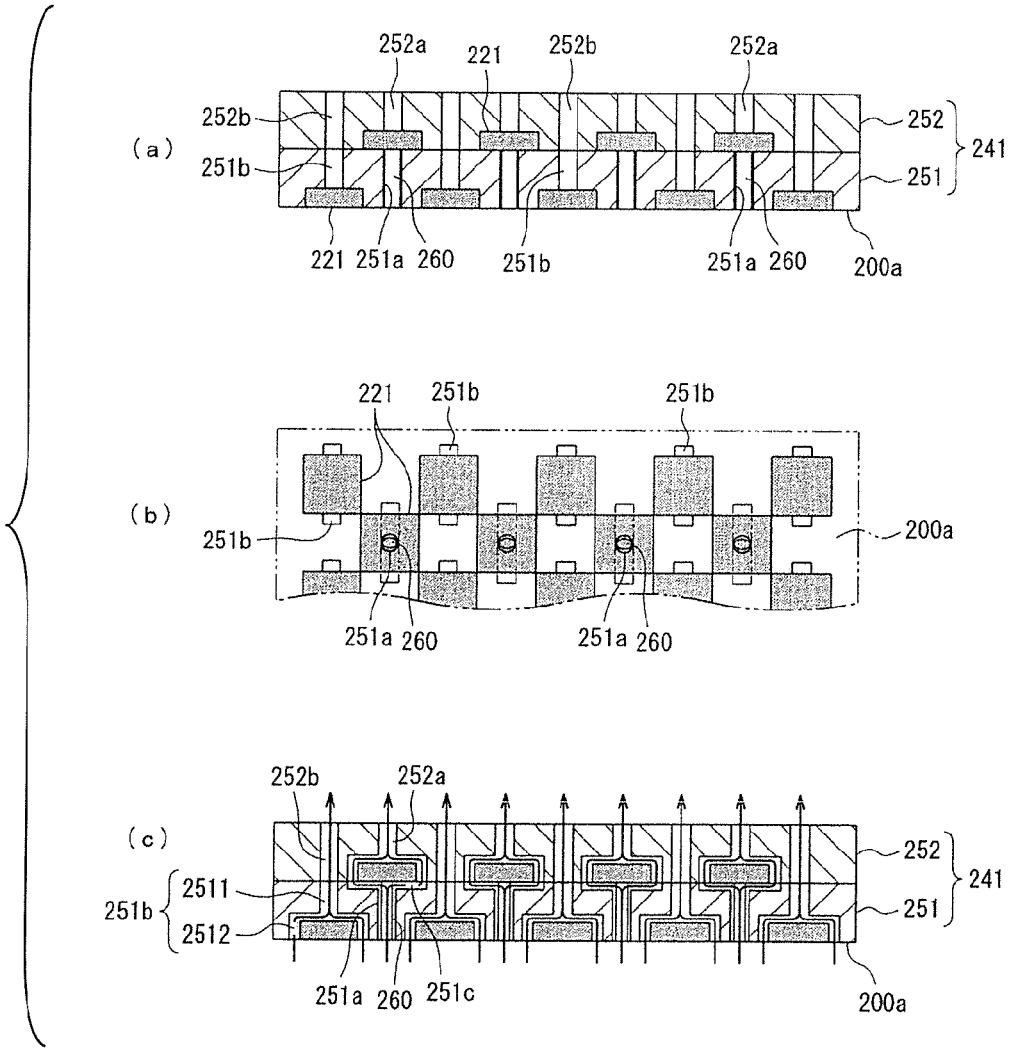
FIG. 14 includes a schematic cross sectional view (a), a partial plan view (b) and a schematic detailed cross sectional view (c) of an ultraviolet radiation head showing an arrangement of a plurality of ventilation paths provided in the ultraviolet radiation head in accordance with a modified example of the third embodiment.

For example, as shown in the diagrams (a) to (c) of FIG. 14, optical fibers 260 may also be used instead of the light guide paths 211*a*, 251*a* as the light guiding section. In such a case, the light emitted from the light emitting elements 221 arranged in the second-layer light source plate may be guided to the light emitting surface 200*a* by the optical fibers 260. The use of optical fibers is more effective because loss of light can be reduced during guiding of the light emitted from the light emitting elements 221.

When optical fibers 260 are used in this manner, the ventilation paths may be maintained by using the light guide paths 251*a* as ventilation paths, providing the optical fibers 260 within the ventilation paths, and forming gaps between the optical fibers 260 and the internal periphery of the light guide paths 251*a* as shown in FIGS. 14(*a*) to 14(*c*) when ventilation paths are formed for cooling as in the third embodiment. In this case, since there is no need to maintain spaces for providing the optical fibers 260, a commensurate size reduction of the base can be anticipated.

When the light is guided using the optical fibers 260 in this manner, it is not necessarily required that the light emitting elements 221 on the first layer be spaced apart so as to be offset from the light emitting elements 221 on the second layer. Specifically, the light emitting elements 221 may be arranged in any manner insofar as the light emitted from the light emitting elements 221 of the layers can be uniformly guided to the light emitting surface 200*a*.

Second Modified Example of Second and Third Embodiments

Figure 15:
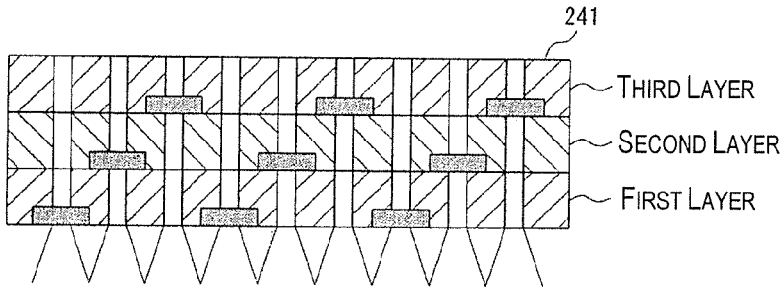
FIG. 15 is a schematic cross sectional view of an ultraviolet radiation head in accordance with a modified example of the second or third embodiment.

In the second and third embodiments described above, two light source plates are layered to form the base. However, the arrangement o the light source plates are not limited to the arrangement in the illustrated embodiments. For example, three light source plates may be layered as shown in FIG. 15, or three or more plates may be layered.

Layering three or more light source plates reduces the number of light emitting elements 221 arranged in a single light source plate by a commensurate amount. Heat is therefore dispersed, and more light guide paths and ventilation paths are formed in a single plate. The efficiency of cooling is therefore commensurately enhanced.

Third Modified Example of Second and Third Embodiments

In the second and third embodiments as described above, the light emitting elements 221 are arranged in a zigzag lattice pattern in a plan view. However, the arrangement of the light emitting elements 221 is not limited to the arrangement in the illustrated embodiment. For example, the spacing between light emitting elements 221 may be arbitrarily set based on the required light intensity, the size of the area that can be irradiated by a single light emitting element 221, and other factors. An aligned arrangement is also not necessary, and the light emitting elements 221 may be arranged so as not to overlap in the plan view, and so that uneven luminance does not occur in the light emitting surface 200*a*.

Fourth Modified Examples of Second and Third Embodiments

In the second and third embodiments as described above, the surface-mounted light emitting elements 221 are embedded in the light source plates, and the light source plates are bonded and layered together. However, it is not necessarily required that the light source plates be bonded and layered together.

A plurality of layers may be layered together via spaces, for example, and in such a case, light guide paths for guiding the light emitted from the light emitting elements 221 arranged in an upper-layer light source plate to the emission surface may be provided between the layers. When the plates are layered via spacers or the like in this manner, the light emitting elements 221 are not limited to surface-mounted light emitting elements, and bullet-shaped elements or other light emitting elements may also be used.

The light emitting elements 221 are also not limited to UVLED elements, and any light emitting bodies may be used insofar as the light emitted from the light emitting bodies is capable of curing an ultraviolet-curable liquid.

The printing device of the present invention can also be applied when printing is performed using a photo-curable liquid having the characteristic of being cured by irradiation by X-rays, visible light rays, infrared rays, electron rays, or other light rays. In such a case, light emitting elements are used that emit light rays that are capable of curing the photo-curable liquid in accordance with the particular photo-curable liquid used.

When the light emitting elements 221 are embedded and arranged in the light source plates, an insulation material having a high thermal conductivity may be injected between the light emitting elements 221 and the light source plates to enhance cooling properties.

In the second and third embodiments described above, the light emitting surface 200*a* corresponds to the light emitting surface, the light emitting elements 221 correspond to the light emitting bodies, and the light guide paths 211*a*, 251*a* correspond to the light guiding sections. The fans 203, 242 correspond to the cooling mechanism.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a liquid spraying head unit configured and arranged to spray a photo-curable liquid to a printing medium; and a light radiation head unit configured and arranged to radiate curing light rays to the photo-curable liquid sprayed on the printing medium to cause the photo-curable liquid to be cured, the light radiation head unit including a light emitting body configured and arranged to emit the curing light ray, the light emitting body being arranged on a light source arrangement surface extending non-parallel to the printing medium, a reflector configured and arranged to reflect the curing light ray emitted from the light emitting body toward the photo-curable liquid sprayed on the printing medium, the reflector being arranged on a reflector arrangement surface facing the light source arrangement surface and extending non-parallel to the printing medium, an auxiliary reflector disposed adjacent to the reflector, and configured and arranged to reflect at least one of the curing light ray emitted from the light emitting body and light reflected by the reflector toward the photo-curable liquid sprayed on the printing medium, and a rectangular parallelepiped member having an emission port that faces the printing medium, the light source arrangement surface being disposed adjacent to an inside of a first side surface of the rectangular parallelepiped member, the reflector arrangement surface being disposed adjacent to an inside of a second side surface of the rectangular parallelepiped member facing the first side surface, and the auxiliary reflector being arranged on third and fourth side surfaces of the rectangular parallelepiped member extending between the first and second side surfaces.

2. The printing device according to claim 1, wherein the light radiation head unit further includes a plurality of additional rectangular parallelepiped members so that the rectangular parallelepiped member and the additional rectangular parallelepiped members are connected together.

3. The printing device according to claim 1, wherein the light radiation head unit includes first and second rectangular parallelepiped members with each of the first and second rectangular parallelepiped members having an emission port facing the printing medium and an opening section provided on a first side surface of each of the first and second rectangular parallelepiped members, each of the first and second rectangular parallelepiped members includes the light source arrangement surface extending between the first side surface and a second side surface of the rectangular parallelepiped member facing the first side surface, with the light source arrangement surface being tilted so that an upper portion of the light source arrangement surface is disposed adjacent to the first side surface, each of the first and second rectangular parallelepiped members includes the auxiliary reflector arranged on third and fourth side surfaces extending between the first and second side surfaces, the first and second rectangular parallelepiped members are connected together so that the first side surface of the second rectangular parallelepiped member is disposed adjacent to the second side surface of the first rectangular parallelepiped member, and the reflector is disposed on the second side surface of the first rectangular parallelepiped member so that the curing light ray emitted from the light emitting body on the light source arrangement surface of the second rectangular parallelepiped member is reflected by the reflector.

4. The printing device according to claim 1, wherein the light radiation head unit includes a cooling mechanism configured and arranged to cool the light emitting body with at least one of the light emitting body and the reflector being disposed adjacent to the cooling mechanism.

5. The printing device according to claim 4, wherein the light emitting body is embedded in the cooling mechanism.

6. A printing device comprising:

a liquid spraying head unit configured and arranged to spray a photo-curable liquid to a printing medium; and a light radiation head unit configured and arranged to radiate curing light rays to the photo-curable liquid sprayed on the printing medium to cause the photo-curable liquid to be cured, the light radiation head unit including a plurality of light emitting bodies configured and arranged to emit the curing light ray, the light emitting bodies being disposed on a light source arrangement surface extending non-parallel to the printing medium, and a reflector configured and arranged to reflect the curing light ray emitted from the light emitting body toward the photo-curable liquid sprayed on the printing medium, the reflector being arranged on a reflector arrangement surface facing the light source arrangement surface and extending non-parallel to the printing medium.

7. A printing device comprising:

a liquid spraying head unit configured and arranged to spray a photo-curable liquid to a printing medium; and a light radiation head unit configured and arranged to radiate curing light rays from a light emitting surface of the light radiation head unit to the photo-curable liquid sprayed on the printing medium to cause the photo-curable liquid to be cured, the light radiation head unit including a base member having a plurality of layers with each of the layers including a plurality of light emitting bodies configured and arranged to emit the curing light rays, and a light guiding section disposed in the base member, and configured and arranged to guide the curing light rays emitted from the light emitting bodies disposed in at least one of the layers to the light emitting surface.

8. The printing device according to claim 7, wherein the light emitting surface is configured and arranged to extend substantially parallel to the printing medium, the light emitting bodies are arranged in each of the layers generally parallel to a planar direction of the light emitting surface so that the light emitting bodies disposed on one of the layers are offset from the light emitting bodies disposed on the other of the layers when viewed in a direction perpendicular to the planar direction of the light emitting surface, and the light guiding section includes a light guide path extending from an emission surface of at least one of the light emitting bodies to the light emitting surface.

9. The printing device according to claim 8, further comprising an air-cooling mechanism, the light guiding section of the base member forming at least a part of a ventilation path communicated with the air-cooling mechanism to cool the light emitting bodies of at least one of the layers.

10. The printing device according to claim 7, wherein the light guiding section includes an optical fiber.

11. The printing device according to claim 7, wherein each of the light emitting bodies includes a surface-mounted light emitting body having a substantially flat emission surface, and the base member is formed by layering a plurality of substrates in which the light emitting bodies are embedded.

12. The printing device according to claim 7, further comprising an air-cooling mechanism, the base member including a ventilation path communicated with the air-cooling mechanism to cool the light emitting bodies of each of the layers.

13. The printing device according to claim 12, wherein the ventilation path extends in the base member from a non-emitting side of each of the light emitting bodies to the light emitting surface via a portion adjacent to a side surface of the light emitting body.

* * * * *